US007125636B2

(12) United States Patent
Miyazaki et al.

(10) Patent No.: US 7,125,636 B2
(45) Date of Patent: Oct. 24, 2006

(54) TONER AND IMAGE-FORMING SYSTEM

(75) Inventors: Rie Miyazaki, Nagano (JP); Takuya Kadota, Hyogo (JP); Hidehiro Takano, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 136 days.

(21) Appl. No.: 10/787,394

(22) Filed: Feb. 27, 2004

(65) Prior Publication Data

US 2004/0234878 A1 Nov. 25, 2004

(30) Foreign Application Priority Data

Feb. 28, 2003 (JP) ..... 2003-053759
Feb. 28, 2003 (JP) ..... 2003-053760
Feb. 28, 2003 (JP) ..... 2003-053761

(51) Int. Cl.
*G03G 9/08* (2006.01)

(52) U.S. Cl. ..... 430/108.1; 430/111.4; 430/108.4; 399/328

(58) Field of Classification Search ..... 430/108.1, 430/111.4, 108.4; 399/328
See application file for complete search history.

(56) References Cited

U.S. PATENT DOCUMENTS 6,300,024 B1 * 10/2001 Yusa et al. ..... 430/45

FOREIGN PATENT DOCUMENTS

| | | | |
|---|---|---|---|
| JP | 09-022772 | A | 1/1997 |
| JP | 3241003 | B2 | 12/2001 |
| JP | 2002-268430 | A | 9/2002 |
| JP | 3322095 | B2 | 9/2002 |

* cited by examiner

*Primary Examiner*—John L Goodrow
(74) *Attorney, Agent, or Firm*—Sughrue Mion, PLLC

(57) ABSTRACT

The present invention provides a toner capable of effectively controlling hot offset of a toner in fixing characteristics, while effectively preventing the winding of a recording medium round a fixing member.

9 Claims, 5 Drawing Sheets

TONER AND IMAGE-FORMING SYSTEM

FIELD OF THE INVENTION

The present invention relates to a technical field of a toner used for fixing by heating images of electrostatic images in electrophotography, electrostatic recording and electrostatic printing.

BACKGROUND OF THE INVENTION

As electrophotography, a method of forming an electrostatic charge image on a photosensitive material, developing the electrostatic charge image by a toner which is carried on a developing roller, transferring the toner image developed on the photosensitive material directly to a recording medium, e.g., paper, or via an intermediate transfer substance, and fixing the toner image on the recording medium by a fixing roller, e.g., a heating roller, on the recording medium, e.g., paper, by press-heating is known.

For obtaining high quality images, the toners used in such a fixing unit by heating fixation are required to have excellent fixing characteristics that a recording medium surely separates from fixing members and does not wind round fixing members after heating fixation at the exit of a fixing unit, and toners do not bring about a so-called hot offset, i.e., the adhesion of melted toners on a heating roller.

In fixation using a heating roller, as the factors which control the fixing property and offset resistance of a toner, it is well known that the storage modulus G' and the loss modulus G" in dynamic viscoelastic characteristics of a toner have influence. Storage modulus G' and loss modulus G" are viscoelastic characteristics of a substance having general viscoelasticity defined by complex elastic modulus in vibration experiment, and the real number part of complex elastic modulus is called storage modulus G' and the imaginary number part is called loss modulus G", specifically, storage modulus is made an index showing the degree of the elasticity of a toner and loss modulus is made an index showing the degree of viscosity.

In general, toners containing a binder resin comprising a polymer show a stress relaxation behavior that generated stress exponentially attenuates when constant strain is given. Therefore, for the purpose of the improvement of fixing property of toner images, such as offset of toners to a fixing roller, and the fixing strength of toners on a recording medium, e.g., paper, and the improvement of dispersibility of colorants, the relaxation modulus and relaxation time of toners which can be obtained by measuring the dynamic viscoelasticity have been conventionally used for confirming the characteristics of toners quantitatively.

Since such a stress relaxation behavior of a toner is greatly influenced by the viscoelasticity of a binder resin and the structure, size and quantity of a release agent dispersed in the resin, the molten condition of a toner can be expressed with a stress relaxation behavior, i.e., relaxation modulus G (t) and relaxation time. It is proposed, therefore, to improve the stability of a toner image, the dispersibility of a release agent, and OHP transparency by the expressing molten condition of a toner at fixing time with relaxation modulus G of viscoelastic is characteristics and relaxation time.

That is, in the toner in this proposal, it is proposed to improve the separability of a fixed sheet, the adhesion property of a fixed image, the bending resistance of a fixed image, the dispersibility of the release agent in a toner, the dispersibility of the colorant in a toner, and fixing characteristics, such as OHP transparency, by prescribing the initial relaxation modulus G (t=0.01) in relaxation time of 0.01 sec obtained by the measurement of the dynamic viscoelastic characteristics of the binder resin of a toner within a prescribed range, and, considering the heating time Dt in fixation, by prescribing the ratio G (r) of the initial relaxation modulus G (t=0.01) to the initial relaxation modulus G (t=0.1) in relaxation time of 0.1 sec, [G (t=0.01)/G (t=0.1)], within a prescribed range. (Refer to, e.g., patent literature 1).

On the other hand, the configurations of the fixing nip parts of fixing members used in fixing units by heating fixation are various.

For instance, fixing units having a fixing nip part of a heating roller and a pressing roller of fixing members taking the configuration of protruding toward the pressing roller side are known (refer to, e.g., patent literature 2).

For instance, fixing units having a fixing nip part of a heating roller and a pressing roller of fixing members and a pressing belt taking the configuration of protruding toward the side of the main heating member are known (refer to, e.g., patent literature 3).

For instance, fixing units having a fixing nip part of a fixing film for heating and a pressing roller taking the configuration of flat surface are known (refer to, e.g., patent literature 4).

[Patent Literature 1]

Japanese Patent No. 3241003 (paragraphs [0020], [0030], [0031] and [0051]).

[Patent Literature 2]

JP-A-2002-268430 (paragraphs [0014], [0015] and FIG. 3) (the term "JP-A" as used herein refers to an "unexamined published Japanese patent application).

[Patent Literature 3]

Japanese Patent 3322095 (paragraphs [0022] to [0026] and FIGS. 1 and 3).

[Patent Literature 4]

JP-A-9-22772 (paragraphs [0004] to [0008], FIGS. 7 and 8)

Various different nip configurations have a great influence on the direction of discharge of a recording medium when discharged from a fixing unit.

For example, in the fixing unit disclosed in patent literature 2, since the fixing nip part of the heating roller and the pressing roller takes the configuration of protruding toward the pressing roller side, the direction of discharge of a recording medium tends to be the direction along the heating roller. Due to this tendency, the recording medium is liable to wind round the heating roller after heating fixation.

However, in the toner disclosed in patent literature 1, it is disclosed to improve fixing characteristics, such as fixing strength, of a toner image by expressing the molten state of a toner by the ratio G (r) of the relaxation modulus G (t), where heating time Dt at fixing time is considered, and the relaxation modulus G (t) after the elapse of certain relaxation time. However, the nip configuration of the fixing unit is not supposed at all in the same patent. Therefore, there remains a problem that it is difficult to effectively prevent a recording medium from winding round the heating roller.

Further, when a toner is made soft for the purpose of improving fixing strength and the like, not only the winding of a recording medium round a heating roller is liable to occur, but hot offset is also liable to occur by the reluctance of separation of softened toner.

Further, for example, in the fixing unit disclosed is in patent literature 3, since the fixing nip part of the heating roller and the pressing belt takes the configuration of protruding toward the heating roller side, the direction of discharge of a recording medium tends to be the direction forcedly released from the heating roller. Due to this tendency, the toner on the recording medium is forcedly peeled off the medium, and hot offset after heating fixation is liable to occur by the reluctance of separation of the toner adhered on the heating roller side and that adhered to the recording medium side.

However, in the toner disclosed in patent literature 3, it is disclosed to improve fixing characteristics, such as fixing strength, of a toner image by expressing the molten state of a toner by the ratio G (r) of the relaxation modulus C (t), where heating time Dt at fixing time is considered, and the relaxation modulus G (t) after the elapse of certain relaxation time. However, the nip configuration of the fixing unit as disclosed in patent literature 3 is not supposed at all in the same patent. Therefore, there remains a problem that it is difficult to effectively prevent hot offset after heating fixation by the reluctance of separation of the toner.

In a fixing unit as disclosed in patent literature 3, where a fixing nip part takes the configuration of protruding toward the heating roller side, a recording medium tends to peel off the heating roller, nonetheless it is difficult to surely prevent the winding of the recording material around the heating roller.

Further, for example, in the fixing unit disclosed in patent literature 4, since the fixing nip part of the fixing film for heating and the pressing roller takes the configuration of flat surface, a recording medium tends to be discharged along the direction of the flat surface of the nip configuration. Due to this tendency, the toner on the recording medium is half forcedly peeled off the fixing film, and hot offset after heating fixation is liable to occur by the reluctance of separation of the toner adhered on the fixing film side and the toner adhered to the recording medium side.

However, in the toner disclosed in patent literature 1, it is disclosed to improve fixing characteristics, such as fixing strength, of a toner image by expressing the molten state of a toner by the ratio G (r) of the relaxation modulus G (t), where heating time Dt at fixing time is considered, and the relaxation modulus G (t) after the elapse of certain relaxation time. However, the nip configuration of the fixing unit as disclosed in patent literature 4 is not supposed at all in the same patent. Therefore, there remains a problem that it is difficult to effectively prevent hot offset after heating fixation by the reluctance of separation of the toner.

In a fixing unit as disclosed in patent literature 4, where a fixing nip part takes the configuration of flat surface, a recording medium tends to peel off the fixing film, nonetheless it is difficult to surely prevent the winding of the recording material around the fixing film.

SUMMARY OF THE INVENTION

The present invention has been done in view of these circumstances, and an object of the present invention is to provide a toner capable of effectively repressing hot offset of a toner in fixing characteristics, while effectively preventing the winding of a recording medium round a fixing member.

In a first aspect of the present invention (hereinafter referred to as "first invention"), the first invention mainly relates to following items:

(1) A toner for use in an image-forming apparatus equipped with an oil-less fixing unit comprising a main heating member and a pressing member, the main heating member gets in contact with an unfixed toner surface on a recording medium and fixes the unfixed toner at a nip part of the main heating member and the pressing member, the main heating member and the pressing member define a boundary surface thereof, and the surface takes a configuration protruding toward the pressing member side, wherein the toner has a initial relaxation modulus G (t=0.01) (Pa) of the toner at 120° C., in relaxation time of 0.01 (sec), of G (t=0.01) [Pa]$\geqq 1.0\times10^5$ [Pa].

(2) The toner according to item 1, wherein the toner contains a release agent in an amount of 3 wt. % or less.

In a second aspect of the present invention (hereinafter referred to as "second invention"), the first invention mainly relates to following items:

(3) A toner for use in an image-forming apparatus equipped with an oil-less fixing unit comprising a main heating member and a pressing member, the main heating member gets in contact with an unfixed toner surface on a recording medium and fixes the unfixed toner at a nip part of the main heating member and the pressing member, the main heating member and the pressing member define a boundary surface thereof, the surface takes a configuration protruding toward the side of the main heating member, wherein the toner has a loss tangent tan δ (=G"/G') of the toner, a ratio of loss modulus G" to storage modulus G' in dynamic relaxation modulus, of from 1.7 to 5.0 at 120° C.

(4) The toner according to item 4, wherein the toner contains a release agent in an amount of 3 wt. % or less.

In a third aspect of the present invention (hereinafter referred to as "third invention"), the first invention mainly relates to following items:

(5) A toner for use in an image-forming apparatus equipped with an oil-less fixing unit comprising a main heating member and a pressing member, the main heating member gets in contact with an unfixed toner surface on a recording medium and fixes the unfixed toner at a nip part of the main heating member and the pressing member, the main heating member and the pressing member define a boundary surface thereof, and the surface takes a configuration of flat surface, wherein the toner has a larger value of loss tangent tan δ (=G"/G') of the toner, the ratio of loss modulus G" to storage modulus G' in dynamic relaxation modulus, at 180° C. than a value of tan δ at 110° C., wherein the difference between the values of tan δ at 180° C. and 110° C. is 1 or more.

(6) The toner according to item 5, wherein the toner contains a release agent in an amount of 3 wt. % or less.

A viscoelasticity regulated in the present invention can be provided by regulating molecular weight, molecular weight distribution, degree of cross-linkage and molecular structure of a resin in the toner of the present invention.

DETAILED DESCRIPTION OF THE INVENTION

Figure 1A:
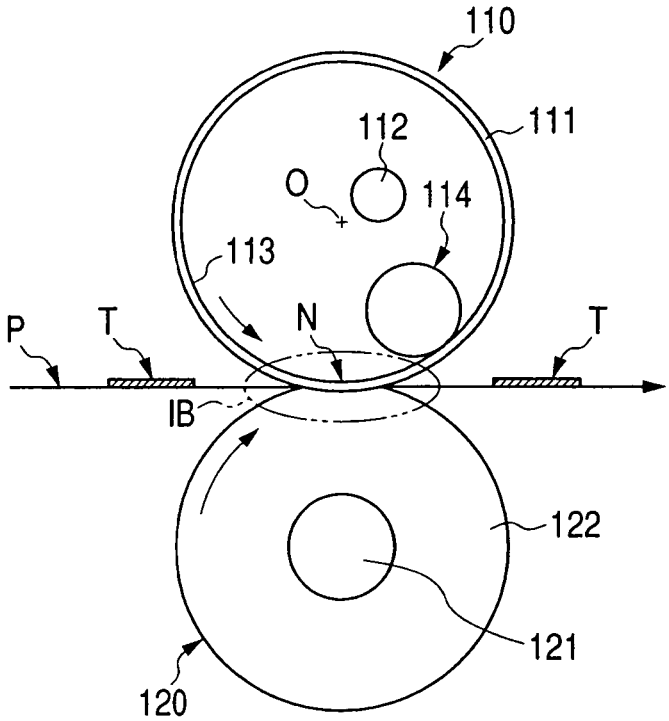
FIG. 1 is a drawing typically showing an example of a fixing unit to which the toner of the first invention is applied; (a) is a front view, and (b) is an enlarged view of part IB in Fig. (a).
Figure 1B:
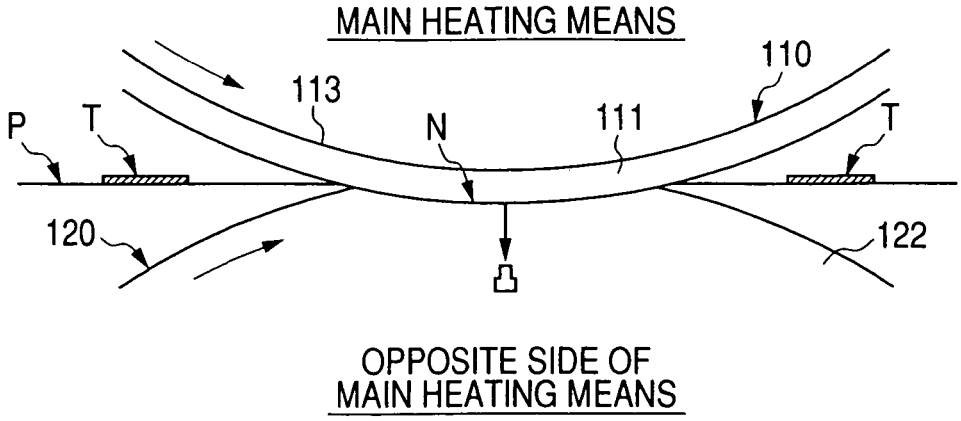

FIG. 1 is a drawing typically showing an example of a fixing unit to which the toner of the first invention is applied; (a) is a front view, and (b) is the enlarged view of part IB in Fig. (a).

The fixing unit shown in FIG. 1 is a fixing unit disclosed in patent literature 2, which can be used in the first invention as an oil-less fixing unit. As this fixing unit can be understood by referring to patent literature 2, the details are omitted here. In the figure, 110 is a heating roller (a heating member), 111 is a metal pipe, 112 is a heater inserted into the inside of pipe 111, 113 is inner periphery of pipe 111, 114 is a high heat transfer member in contact with inner periphery 113 of pipe 111, 120 is a pressing roller (a pressing member), 121 is a shaft, 122 is an elastic body charged around shaft 121, P is a paper (a recording medium), T is the toner of the toner image on paper P, and N is a fixing nip part where rollers 110 and 120 are in contact with each other with pressure. The fixing unit of this example is equipped with one heating roller 110, accordingly heating roller 110 corresponds to the main heating member of the first invention.

Rollers 110 and 120 of this fixing unit are in contact with each other with pressure. In that case, as shown in FIG. 1(*b*) by enlargement, elastic body 122 of pressing roller 120 is concaved elastically by metal pipe 111 of heating roller 110. Thus fixing nip part N in this fixing unit takes the configuration of convexity toward pressing roller 120 side in the orthogonal section of both rotary shafts of heating roller 110 and pressing roller 120 (configuration of protruding downward in Fig. (a) and (b)). In the case of a fixing unit not using a heating roller and a pressing roller, the section that defines the convexity is substantially the same section as the orthogonal section of both rotary shafts.

In the fixing unit shown in the figure, when heating roller 110 is rotated anticlockwise, pressing roller 120 rotates clockwise by the rotation of heating roller 110. In the state of rotating both rollers 110 and 120, paper P on which a toner image has been transferred by a transfer member not shown in the figure is heated by heater 112 of heating roller 110 while transiting through fixing nip part N of heating roller 110 and pressing roller 120 in the direction shown by the arrow (on the right side in the figure),—thereby the toner image is fixed on paper P. At this time, uniformalization of temperature distribution in the direction of shaft line of heating roller 110 is efficiently contrived with high heat transfer member 114.

In the fixing unit shown in FIGS. 1(*a*) and (*b*), heater 112 is provided only on the side of toner image on paper P (fixing surface side) and heats paper P from the toner image side, but a fixing unit in which the toner of the first invention is used may be equipped with a heater also on the side opposite (back surface side of fixing surface) to the side of the toner image on paper P (fixing surface side) in addition to heater 112 to thereby heat paper P secondarily from back surface side of fixing surface. In such a case, heating roller 110 directly in contact with the fixing surface side of paper P is a main heating member.

In the exemplified fixing unit, two rollers of heating roller 110 and pressing roller 120 are used as fixing members but a fixing unit equipped with a belt and rollers can also be used.

A binder resin capable of controlling dynamic viscoelastic characteristics in fixing region is used in the toner of the first invention. In stress relaxation measurement described later, this binder resin of the toner has initial relaxation modulus G (t=0.01) [Pa] in relaxation time of 0.01 (sec), which is the starting time of measuring stress relaxation, at 120° C. of $10\times10^5$ [Pa] or more {initial relaxation modulus G (t=0.01) [Pa]$\geqq 1.0\times10^5$ [Pa], preferably G (t=0.01) [Pa]$\geqq 1.2\times10^5$ [Pa]}.

Here, relaxation time 0.01 (sec) is the time required to be capable of measuring stress relaxation after applying stress on a toner and restoring a stationary state in stress relaxation measurement described later, i.e., the starting time of the measurement of stress relaxation. Further, the temperature 120° C. is set considering the temperature of the toner that lowers after the paper is discharged from the outlet of fixing nip part N.

Figure 2A:
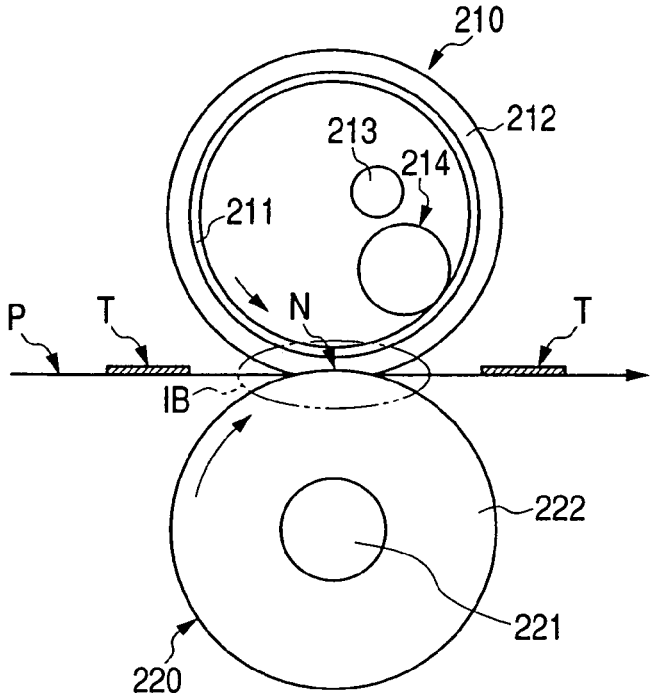
FIG. 2 is a drawing typically showing an example of a fixing unit to which the toner of the second invention is applied; (a) is a front view, and (b) is the enlarged view of part IB in Fig. (a).
Figure 2B:
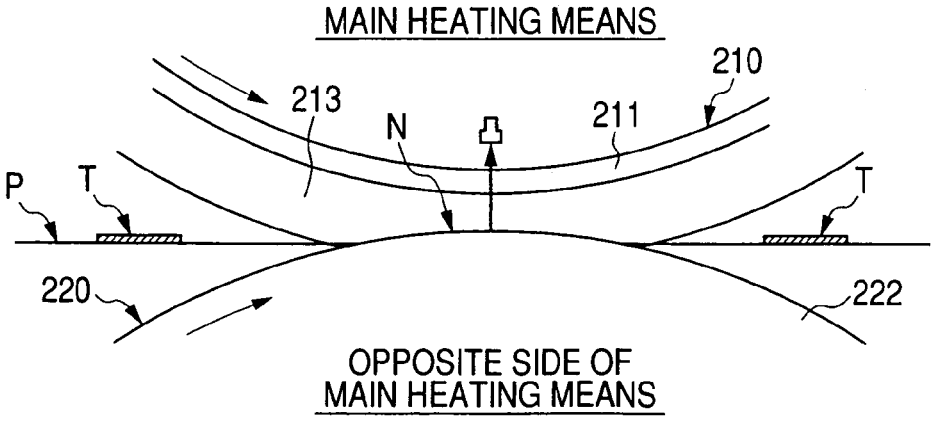

FIG. 2 is a drawing typically showing an example of a fixing unit to which the toner of the second invention is applied; (a) is a front view, and (b) is an enlarged view of part IB in Fig. (a).

The fixing unit shown in FIG. 2 is a fixing unit that can be used in the second invention as an oil-less fixing unit. In the figure, 210 is a heating roller (a heating member), 211 is a metal pipe, 212 is a heat transfer elastic body provided on the outer periphery of pipe 211, 213 is a heater inserted into the inside of pipe 211, 214 is a high heat transfer member in contact with the inner periphery of pipe 211, 220 is a pressing roller (a pressing member), 221 is a shaft, 222 is a pressing member charged around shaft 221, P is a paper (a recording medium), T is the toner of the toner image on paper P, and N is a fixing nip part where rollers 210 and 220 are in contact with each other with pressure. The fixing unit of this example is equipped with one heating roller 210, accordingly heating roller 210 corresponds to the main heating member of the second invention. Since the structure of heat transfer from heater 213 and high heat transfer member 214 to pipe 211 is substantially the same as the heating roller disclosed in JP-A-2002-268430, and is easily understood by referring to the same patent, the details are omitted here.

Rollers 210 and 220 of this fixing unit are in contact with each other with pressure. In that case, as shown in FIG. 2(*b*) by enlargement, elastic body 212 of heating roller 210 is concaved elastically by pressing member 222 of pressing roller 220. Thus fixing nip part N in this fixing unit takes the configuration of convexity toward main heating member heating roller 210 side in the orthogonal section of both rotary shafts of heating roller 210 and pressing roller 220 (configuration of protruding upward in Fig. (a) and (b)). In the case of a fixing unit not using a heating roller and a pressing roller, the section that defines the convexity is substantially the same section as the orthogonal section of both rotary shafts.

In the fixing unit shown in the figure, when heating roller 210 is rotated anticlockwise, pressing roller 220 rotates clockwise by the rotation of heating roller 210. In the state of rotating both rollers 210 and 220, paper P on which a toner image has been transferred by a transfer member not shown in the figure is heated by heater 213 of heating roller 210 while transiting through fixing nip part N of heating roller 210 and pressing roller 220 in the direction shown by the arrow (on the right side in the figure), thereby the toner image is fixed on paper P. At this time, uniformalization of temperature distribution in the direction of shaft line of heating roller 210 is efficiently contrived with high heat transfer member 214.

In the fixing unit shown in FIG. 2(*a*) and (*b*), heater 213 is provided only on the toner image side of paper P (fixing surface side) and heats paper P from the toner image side, but a fixing unit in which the toner of the second invention is used may be equipped with a heater also on the side opposite (back surface side of fixing surface) to the side of the toner image on paper P (fixing surface side) in addition to heater 213 to thereby heat paper P secondarily from back surface side of fixing surface. In such a case, heating roller 210 directly in contact with the fixing surface side of paper P is a main heating member.

In the exemplified fixing unit, two rollers of heating roller 210 and pressing roller 220 are used as fixing members but a fixing unit equipped with a belt and rollers can also be used.

A binder resin capable of controlling dynamic viscoelastic characteristics in fixing region is used in the toner of the second invention. The ratio of loss modulus G" to storage modulus G' in dynamic relaxation modulus of dynamic viscoelastic characteristics, i.e., loss tangent tan δ, of the binder resin of the toner of the second invention, is set at 1.7 to 5.0 at 120° C., preferably from 1.9 to 4.5.

Figure 3:
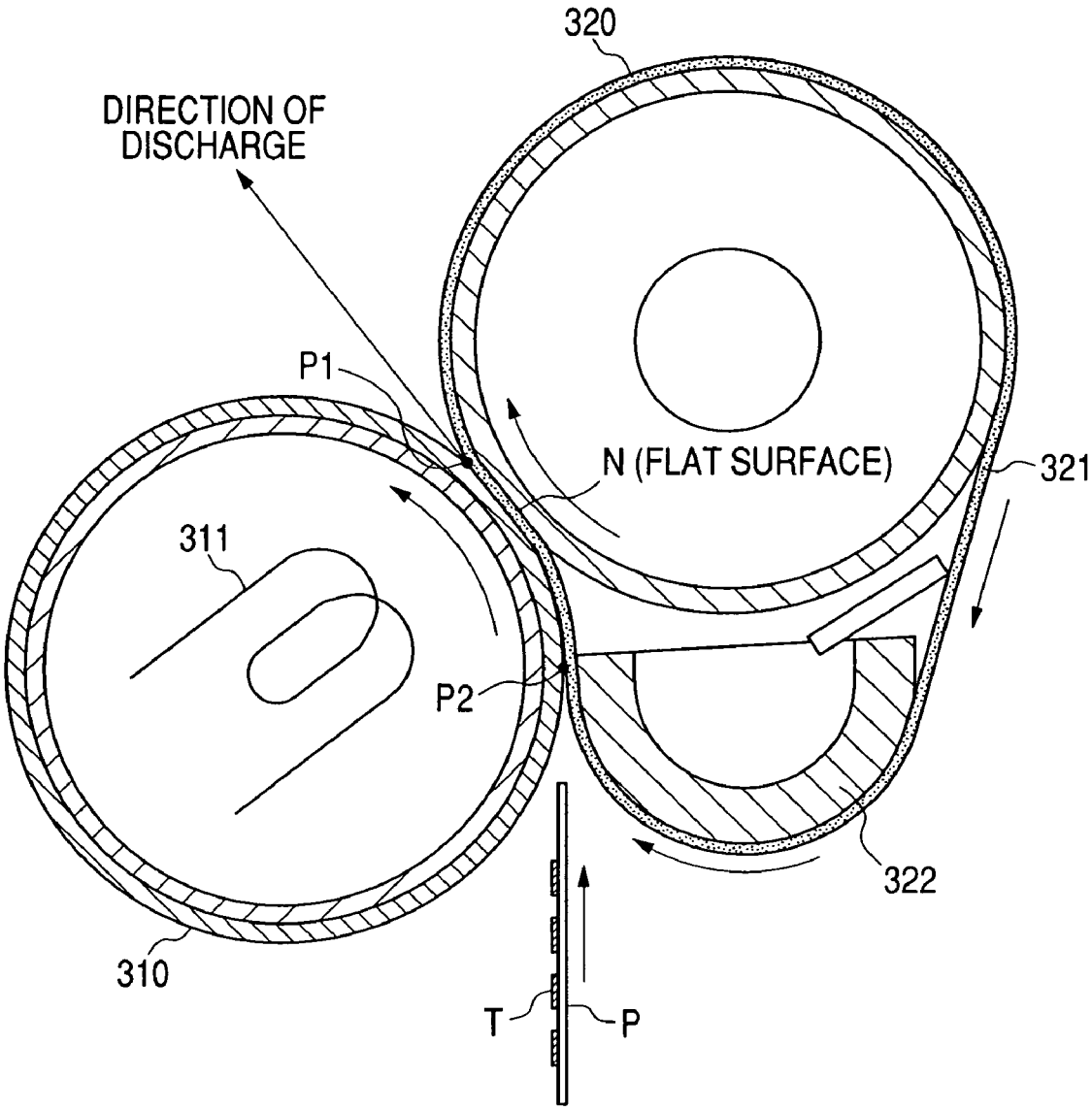
FIG. 3 is a drawing typically showing an example of a fixing unit to which the toner of the third invention is applied.

FIG. 3 is a partially enlarged drawing typically showing an example of a fixing unit to which the toner of the third invention is applied.

The fixing unit shown in FIG. 3 is a fixing unit that can be used in the third invention as an oil-less fixing unit. Briefly describing, in the figure, 310 is a heating roller (a heating member), 311 is a heater, 320 is a driving brace member (a pressing roller, a pressing member), 321 is a fixing belt, 322 is a brace member, P is a paper (a recording medium), T is an unfixed toner on paper P, and N is a fixing nip part where fixing belt 321 and heating roller 310 are brought into contact with pressure.

The surface hardness of heating roller 310 and the surface hardness of driving brace member 320 are set to be the same and the configuration of the nip part is set to be flat surface. Brace member 322 is also in contact with heating roller 310. Driving brace member 320 and brace member 322 both function as brace members to extend fixing belt 321. A part of fixing belt 321 is wound around heating roller 310 between point P1 where fixing belt 321 is apart from heating roller 310 and point P2 where fixing belt 321 starts to contact with heating roller 310. In this example, heating roller 310 comes to function as a pressing member against driving brace member 320 and brace member 322. In that case, driving brace member 320 functions as a backup member but driving brace member 320 also gets to press heating roller 310 by the reaction at that time. In this case, driving brace member 320 is also taken as a pressing member in the third invention. In the case where heating roller 310 is pressed from the side of driving brace member 320, driving brace member 320 is of course the pressing member in the third invention.

When driving brace member 320 is driven to rotate clockwise, fixing belt 321 also rotates clockwise, and the rotary driving force of driving brace member 320 is transferred to heating roller 310 by the rotation of fixing belt 321, thus heating roller 310 rotates anticlockwise. In this state, paper P (a recording medium) on which unfixed toner T is adhered is coming in from the lower side in FIG. 3 at point P2 between heating roller 310 and fixing belt 321, and paper P is discharged at point P1 in the paper discharge direction (the level direction of nip part N). Unfixed toner T is fixed by pressure with heating between point P2 and point P1.

In the fixing unit shown in FIG. 3, heater 311 is provided only on the side of toner image of unfixed toner on paper P (fixing surface side) and heats paper P from the toner image side, but a fixing unit in which the toner of the third invention is used may be equipped with a heater also on the side opposite (back surface side of fixing surface) to the side of toner image on paper P (fixing surface side) in addition to heater 311 to thereby heat paper P secondarily from back surface side of fixing surface. In such a case, heater 311 directly in contact with the fixing surface side of paper P is a main heating member.

In the exemplified fixing unit, two rollers of heating roller 310 and fixing belt 321 are used as fixing members but a fixing unit equipped with two rollers of a heating roller and a pressing roller in place of fixing belt 321 can also be used.

A binder resin capable of controlling dynamic viscoelastic characteristics in fixing region is used in the toner of the third invention. The ratio of loss modulus G" to storage modulus G' in dynamic relaxation modulus, i.e., loss tangent tan δ (=G"/G'), at 180° C. of the binder resin of the toner in the third invention is set at a higher value than loss tangent tan δ at 110° C., and the difference between loss tangent tan δ at 180° C. and 110° C. is 1 or more.

As the binder resins which are used in the toner of the present invention and capable of controlling viscoelastic characteristics in a fixing region, binder resins having both a crystalline region and an amorphous region are preferably used, e.g., resins having a urethane bond and a urea bond, resins comprising the blend of a crystalline polyester resin and an amorphous polyester resin, and polyester resins comprising a block copolymer of a crystalline part and an amorphous part, are exemplified. Amorphous polyester and block polyester are particularly preferably used as the binder resins of the invention.

Viscoelastic characteristics in the fixing region can also be controlled in the compositions which are designed to previously control the polymerization of a binder resin by blending a polymerization initiator and a crosslinking initiator which exhibit their functions when heat energy higher than the prescribed quantity is given at fixing time, thereby the polymerization of the binder resin in the toner progresses when heat energy is given in the range of fixing temperature, and the binder resin is crosslinked and the molecular weight increases.

Figure 4:
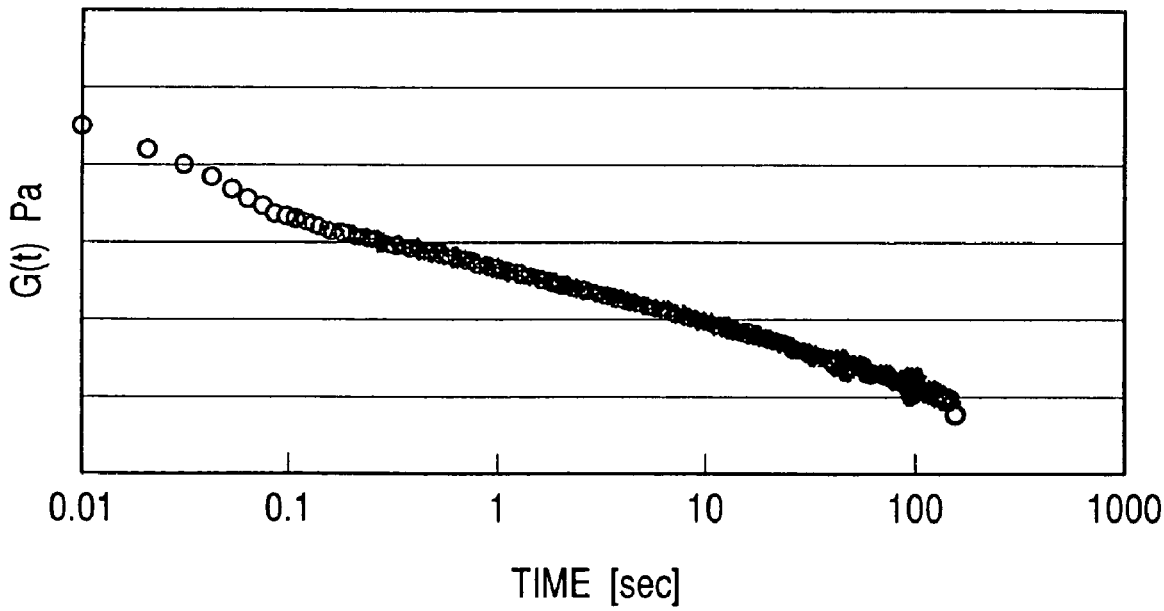
FIG. 4 is a drawing showing an example of relaxation modulus G of a toner comprising a binder resin of a general polymer.

The binder resin for use in the toner of the present invention comprises a polymer, and a polymer generally has a property of showing viscoelastic characteristics in a molten state of a toner. As is shown in FIG. 4, when certain strain is given, the stress of the toner is relaxed with time t (sec) in the stress relaxation measurement described later, so that the relaxation modulus G (t) [Pa], which is one of viscoelastic characteristics, shows a property of lessening with relaxation time t (sec).

As the binder resins in toners having these viscoelastic characteristics, the toner of the invention is described below with binder resins using conventionally well-known polyester resins as an example.

The toner of the example comprises toner particles comprising a polyester resin containing a colorant and a charge controlling agent kneaded and pulverized. And the binder resin has functions of retaining colorant particles in toner particles, being softened by the heat and pressure of fixing rollers in fixation, and adhering the toner particles to a transfer material, e.g., paper. However, when the molecular weight of the binder resin is lowered and the softening temperature is lowered for the purpose of low temperature fixation, the reductions of glass transition temperature, strength, the retention of colorant, offset resistance, the strength of fixed images, and the storage stability are brought about.

Constitutional Components of Toner

The toner of the present invention can be manufactured with materials containing at least a resin as the main component (hereinafter sometimes referred to as merely "a resin").

Each component of the materials for use in manufacturing the toner of the invention is described below.

1. Resin (Binder Resin)

The resins (binder resins) in the present invention mainly comprise polyester resins. The content of polyester resins in the resins is preferably 50 wt. % or more, and more preferably 80 wt. % or more.

In general, polyester resins consist of an alcohol component (including those having 2 or more hydroxyl groups) and a carboxylic acid component (including divalent or higher carboxylic acids and derivatives thereof).

As the alcohol components, those having 2 or more hydroxyl groups can be used, such as chain diols, e.g., ethylene glycol, 1,3-propanediol, 1,2-propylene glycol, 1,3-propylene glycol, 1,4-butanediol, diethylene glycol, 1,5-pentanediol, 1,6-hexanediol, dipropylene glycol, triethylene glycol, tetraethylene glycol, 1,2-propanediol, 1,3-butanediol, 2,3-butanediol, neopentyl glycol(2,2-dimethylpropane-1,3-diol), 1,2-hexanediol, 2,5-hexane-diol, 2-methyl-2,4-pentanediol, 3-methyl-1,3-pentanediol, 2-ethyl-1,3-hexanediol, 2-butyl-2-ethyl-1,3-propanediol, 2,4-diethyl-1,5-pentanediol, polyethylene glycol, polypropylene glycol, and polytetramethylene glycol, cyclic diols, such as alkylene oxide adducts of bisphenol A, e.g., polyoxypropylene(2.2)-2,2-bis(4-hydroxyphenyl)-propane, polyoxypropylene(3.3)-2,2-bis(4-hydroxy-phenyl)propane, polyoxyethylene(2.0)-2,2-bis(4-hydroxy-phenyl)propane, polyoxypropylene-(2.0)-polyoxy-ethylene(2.0)-2,2-bis(4-hydroxyphenyl)propane, and polyoxypropylene(6)-2,2-bis(4-hydroxyphenyl)propane, 2,2-bis(4-hydroxycyclohexyl)propane, alkylene oxide adducts of 2,2-bis(4-hydroxycyclohexyl)propane, 1,4-cyclohexanediol, 1,4-cyclohexanedimethanol, hydrogenated bisphenol A, and alkylene oxide adducts of hydrogenated bisphenol A, and trivalent or higher polyhydric alcohols, e.g., sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene are exemplified.

The alcohol components mainly comprising aliphatic diols having two hydroxyl groups are particularly used in the present invention. Further, the alcohol components may comprise aliphatic alcohols having three or more hydroxyl groups.

As the aliphatic alcohols having two or more hydroxyl groups, such as chain diols, e.g., ethylene glycol, 1,3-propanediol, 1,2-propylene glycol, 1,3-propylene glycol, 1,4-butanediol, diethylene glycol, 1,5-pentanediol, 1,6-hexanediol, dipropylene glycol, triethylene glycol, tetraethylene glycol, 1,2-propanediol, 1,3-butanediol, 2,3-butanediol, neopentyl glycol(2,2-dimethylpropane-1,3-diol), 1,2-hexanediol, 2,5-hexanediol, 2-methyl-2,4-pentanediol, 3-methyl-1,3-pentanediol, 2-ethyl-1,3-hexanediol, 2-butyl-2-ethyl-1,3-propanediol, 2,4-diethyl-1,5-pentanediol, polyethylene glycol, polypropylene glycol, and polytetramethylene glycol, and cyclic diols, e.g., 2,2-bis(4-hydroxycyclohexyl)propane, alkylene oxide adducts of 2,2-bis(4-hydroxycyclohexyl)-propane, 1,4-cyclohexanediol, 1,4-cyclohexanedimethanol, hydrogenated bisphenol A, and alkylene oxide adducts of hydrogenated bisphenol A are exemplified.

Thus in the present invention, the alcohol component mainly comprises aliphatic diol, preferably 50 molt or more of aliphatic diol, and more preferably 80 molt or more of aliphatic diol.

As the carboxylic acid components, e.g., divalent or higher carboxylic acids, and derivatives thereof (e.g., acid anhydrides and lower alkyl esters) can be used, e.g., o-phthalic acid (phthalic acid), terephthalic acid, isophthalic acid, succinic acid, adipic acid, sebacic acid, azelaic acid, octylsuccinic acid, cyclohexanedicarboxylic acid, fumaric acid, maleic acid, itaconic acid, trimellitic acid pyromellitic acid and derivatives of these acids (e.g., anhydrides and lower alkyl esters) are exemplified.

In the present invention, it is particularly preferred that the carboxylic acid component comprise divalent dicarboxylic acid.

The examples of divalent carboxylic acids include e.g., o-phthalic acid (phthalic acid), terephthalic acid, isophthalic acid, succinic acid, adipic acid, sebacic acid, azelaic acid, octylsuccinic acid, cyclohexanedicarboxylic acid, fumaric acid, maleic acid, itaconic acid, and derivatives of these acids (e.g., anhydrides and lower alkyl esters).

In the present invention, it is particularly preferred to use polyester resins containing block polyesters and amorphous-polyesters as described later. These polyester resins are described in detail below.

1-1. Block Polyester:

Block polyester comprises a block copolymer having a crystalline block obtained by condensation of an alcohol component and a carboxylic acid component, and an amorphous block that is lower in crystallinity than the crystalline block.

(1) Crystalline Block

As compared with amorphous blocks or amorphous polyesters, crystalline blocks are high in crystallinity. That is, the structure of molecular arrangement of crystalline blocks is strong and stable as compared with those of amorphous blocks or amorphous polyesters. Therefore, crystalline blocks contribute to the elevation of the strength of a toner as a whole. As a result, the toner finally obtained is strong in mechanical stresses and excellent in durability and storage stability.

Incidentally, highly crystalline resins generally have a so-called sharp melt property as compared with low crystalline resins. That is, highly crystalline resins have a property of exhibiting a sharp figure of endothermic peak as compared with low crystalline resins when subjected to the measurement-of endothermic peak of melting temperature by differential scanning calorimetry (DSC).

On the other hand, as described above, crystalline blocks are high in crystallinity. Thus crystalline blocks have a function of imparting a sharp melt property to block polyesters. Therefore, the toner finally obtained can maintain excellent stability in figure at relatively high temperature (the temperature near the melting temperature of the block polyester) at which the amorphous polyester described later is sufficiently softened. Accordingly, when these block polyesters are used, a sufficient fixing ability (fixing strength) can be obtained in a broad temperature range.

Further, crystals having high hardness and appropriate sizes can be precipitated in a toner by the presence of these crystalline blocks. Due to such crystals, the stability of the figure of a toner becomes excellent, in particular stable to mechanical stresses. In addition, by the presence of these crystals in a toner, external additives, which are described later, can be surely retained around the surfaces of toner particles (mother particles) (external additives can be effectively prevented from being buried in mother particles), so that the functions of external additives (functions of imparting e.g., excellent flowability and electrification property) can be sufficiently exhibited.

The constitutional components of crystalline blocks are described below.

As the alcohol components constituting crystalline blocks, those having two or more hydroxyl groups can be used, preferably diol components having two hydroxyl groups. As such diol components having two hydroxyl groups, aromatic diols having an aromatic cyclic structure and aliphatic diols not having an aromatic cyclic structure are exemplified. As the aromatic diols, e.g., bisphenol A and alkylene oxide adducts of bisphenol A (e.g., polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene(2.0)-2,2-bis(4-hydroxyphenyl)propane, and polyoxypropylene(6)-2,2-bis(4-hydroxyphenylpropane) are exemplified. As the aliphatic diols, such as chain diols, e.g., ethylene glycol, 1,3-propanediol, 1,2-propylene glycol, 1,3-propylene glycol, 1,4-butanediol, diethylene glycol, 1,5-pentane-diol, 1,6-hexanediol, dipropylene glycol, triethylene glycol, tetraethylene glycol, 1,2-propanediol, 1,3-butanediol, 2,3-butanediol, neopentyl glycol(2,2-dimethylpropane-1,3-diol), 1,2-hexanediol, 2,5-hexane-diol, 2-methyl-2,4-pentanediol, 3-methyl-1,3-pentanediol, 2-ethyl-1,3-hexanediol, 2-butyl-2-ethyl-1,3-propanediol, 2,4-diethyl-1,5-pentanediol, polyethylene glycol, polypropylene glycol, and polytetramethylene glycol, and cyclic diols, e.g., 2,2-bis(4-hydroxycyclohexyl)propane, alkylene oxide adducts of 2,2-bis(4-hydroxycyclohexyl)-propane, 1,4-cyclohexanediol, 1,4-cyclohexanedimethanol, hydrogenated bisphenol A, and alkylene oxide adducts of hydrogenated bisphenol A, are exemplified.

The diol components constituting crystalline blocks are not particularly restricted, but preferably at least a part of the diol components is aliphatic diol, more preferably aliphatic diol having 80 mol % or more of the diol components, and still more preferably aliphatic diol having 90 mol % or more. By this constitution, the crystallinity of block polyesters (crystalline block) can be heightened and the above effects can further be elevated.

The diol components constituting a crystalline block preferably have a straight chain molecular structure having from 3 to 7 carbon atoms, and diol components having hydroxyl groups at both terminals (diol represented by the formula: $HO—(C)_2H_n—OH$ (provided that n is from 3 to 7)). Since crystallinity increases and friction coefficient lowers by containing these diol components, the resisting properties against mechanical stresses are improved and excellent durability and storage stability can be obtained. The examples of such diols include, e.g., 1,3-propanediol, 1,4-butanediol, 1,5-pentanediol and 1,6-hexanediol. Of these diols, 1,4-butanediol is preferred. By containing 1,4-butanediol, the above effects become particularly conspicuous.

When 1,4-butanediol is contained as the diol component constituting a crystalline block, it is more is preferred that the diol constituting a crystalline block has 50 mol % or more of 1,4-butanediol, and still more preferred that the diol constituting a crystalline block has 80 mol % or more of 1,4-butanediol. By this constitution, the above effects become further conspicuous.

As the carboxylic acid components constituting a crystalline block, divalent or higher carboxylic acids and derivatives thereof (e.g., acid anhydrides and lower alkyl esters) can be used. Of those carboxylic acid components, divalent dicarboxylic acids and derivatives thereof are preferably used. The examples of dicarboxylic acids include, e.g., o-phthalic acid (phthalic acid), terephthalic acid, isophthalic acid, succinic acid, adipic acid, sebacic acid, azelaic acid, octylsuccinic acid, cyclohexanedicarboxylic acid, fumaric acid, maleic acid, itaconic acid, and derivatives of these acids (e.g., anhydrides and lower alkyl esters).

The dicarboxylic acid components constituting a crystalline block are not particularly restricted, but it is preferred that the dicarboxylic acid components at least partially have a terephthalic acid skeleton, more preferably 50 mol % or more of the dicarboxylic acid components have a terephthalic acid skeleton, and still more preferably 80 mol % or more of the dicarboxylic acid components have a terephthalic acid skeleton. By this constitution, the toner finally obtained comes to be a toner well balanced in various characteristics required of the toner.

The content of the crystalline block in block polyester is not particularly restricted, but the content is preferably from 5 to 60 mol %, and more preferably from 10 to 40 mol %. When the content of the crystalline block is less than the lower limit, there is the possibility that the effect by containing the crystalline block cannot be sufficiently exhibited according to the content of the block polyester. On the other hand, when the content of the crystalline block is higher than the upper limit, there is the possibility that the compatibility of block polyester and the amorphous polyester described later lowers, since the content of the amorphous block relatively lowers.

Crystalline block may contain components other than the above alcohol components and carboxylic acid components.

The average molecular weight (weight average molecular weight, Mw) of the block polyester containing the crystalline block is not particularly limited, but it is preferably from $1\times10^4$ to $3\times10^5$, and more preferably from $1.2\times10^4$ to $1.5\times10^5$. When the average molecular weight, Mw, is less than the lower limit, there is the possibility that the mechanical strength of the finally-obtained toner lowers and sufficient durability (storage stability) cannot be obtained. When the average molecular weight Mw is too small, cohesive failure is liable to occur in the fixing of the toner, and the offset resistance tends to lessen. While when the average molecular weight Mw exceeds the upper limit, intercrystalline crack is liable to occur in the fixing of the toner, and the wettability to a transfer material (a recording medium), e.g., paper, lowers, as a result the quantity of heat required in fixing increases.

The glass transition temperature $T_g$ of block polyester is not particularly restricted, but it is preferably from 50 to 75° C., and more preferably from 55 to 70° C. When the glass transition temperature is less than the lower limit, the storage stability (heat resistance) of the toner decreases, and there are cases where fusing occurs among toner particles according to the use environment. On the other hand, when the glass transition temperature exceeds the upper limit, low temperature fixing ability and transparency decrease. When the glass transition temperature is too high, there is the possibility that the effect of the thermal treatment of sphere-making as described later cannot be sufficiently exhibited. Glass transition temperature can be measured in accordance with JIS K 7121.

The softening temperature of block polyester $T_{1/2}$ is not particularly restricted, but it is preferably from 90 to 160° C., and more preferably from 100 to 150° C. When the softening temperature is less than the lower limit, the storage stability of the toner lowers and there is the possibility that sufficient durability cannot be obtained. When the softening temperature is too low, cohesive failure is liable to occur in the fixing of the toner, and the offset resistance tends to lessen. While when the softening temperature exceeds the upper limit, intercrystalline crack is liable to occur in the fixing of the toner, and the wettability to a transfer material (a recording medium), e.g., paper, lowers, as a result the quantity of heat required in fixing increases. The softening temperature $T_{1/2}$ can be found as the temperature of the point on the flow curve corresponding to h/2 of the flow chart for analysis which can be obtained by measuring by using a flow tester on conditions of a sample amount of 1 g, pit of the die of 1 mm, length of the die of 1 mm, load of 20 kgf, preheating time of 300 seconds, temperature at starting of measurement of 50° C., and velocity of temperature-up of 5° C./min.

The melting temperature $T_m$ of block polyester (the central value $T_{mp}$ of the peaks in the measurement of the endothermic peak of melting temperature by differential scanning calorimetry as described later) is not particularly restricted, but it is preferably 190° C. or more, and more preferably from 190 to 230° C. When the melting temperature is less than 190° C., there is the possibility that the effect of improving offset resistance cannot be sufficiently obtained. While when the melting temperature is too high, it is required to increase the temperature of materials in the kneading process as described later. As a result, the ester exchange reaction of resin materials is liable to progress, and there are cases where the design of resin is difficult to be sufficiently reflected in the toner finally obtained. Melting temperature can be obtained, e.g., by the measurement of endothermic peak by differential scanning calorimetry (DSC).

When the toner finally obtained is used in a fixing unit having a fixing roller as described later, it is preferred to satisfy the relationship of $T_{fix} \leqq T_m(B) \leqq (T_{fix}+100)$, more preferably to satisfy the relationship $(T_{fix}+10) \leqq T_m(B) \leqq (T_{fix}+70)$, with the melting temperature of block polyester (the central value $T_m$ of the peaks in the measurement of the endothermic peak of melting temperature by differential scanning calorimetry as described later) as $T_m(B)$[° C.], and the standard set surface temperature of the fixing roller as $T_{fix}$[° C.]. By satisfying the relationship, the adhesion of the toner to the fixing roller of the fixing unit described later can be effectively prevented. Further, since block polyester has a property of making crystal of a proper size easily as described above, stability and durability can be maintained after fixation of the toner on a recording medium by satisfying the above relationship. Particularly when block polyester is used in combination with the amorphous polyester described later, the amorphous polyester can be sufficiently softened at fixing time. Accordingly, the fixing ability (fixing strength) of the toner on a recording medium can be satisfactorily elevated and the low temperature fixing ability of the toner can be excelled. In addition, since block polyester is liable to form crystals having high hardness, the obtained toner is excellent in the stability after fixation.

It is preferred that the melting temperature of block polyester be higher than the softening temperature of the later-described amorphous polyester. By this constitution, the toner finally obtained is improved in the stability of configuration and shows particularly excellent stability against mechanical stresses. Further, when the melting temperature of block polyester is higher than the softening temperature of the later-described amorphous polyester, e.g., in the thermal treatment of sphere-making as described later, the amorphous polyester can be thoroughly softened while ensuring the stability of configuration of the powders for manufacturing the toner in a certain degree by the block polyester. As a result, the thermal sphere-making treatment can be carried out efficiently, and the degree of circularity of the toner (toner particles) finally obtained can be made relatively high.

Incidentally, as described above, as block polyesters contain crystalline blocks having high crystallinity, they have a so-called sharp melt property as compared with relatively low crystalline resins (e.g., the later-described amorphous polyesters and the like).

As the index showing crystallinity, e.g., with the central value of the peak as $T_{mp}$[° C.] and the shoulder peak value as $T_{ms}$[° C.] in the measurement of endothermic peak of melting temperature by differential scanning calorimetry (DSC), the ΔT value represented by $\Delta T = T_{mp} - T_{ms}$ is exemplified. The smaller the ΔT value, the higher is the crystallinity.

The ΔT value of block polyester is preferably 50° C. or less, and more preferably 20° C. or less. The measuring conditions of $T_{mp}$[° C.] and $T_{ms}$[° C.] are not especially restricted, but the measurement is effected by increasing the temperature of the sample block polyester to 200° C. at a temperature-up velocity of 10° C./min, lowering the temperature at a temperature-down velocity of 10° C./min, and again at a temperature-up velocity of 10° C./min.

Block polyesters are higher in crystallinity than the amorphous polyesters described later. Accordingly, the relationship $\Delta T_A > \Delta T_B$ is satisfied, when the ΔT value of amorphous polyester as $\Delta T_A$[° C.] and the ΔT value of block polyester as $\Delta T_B$[° C.]. In particular in the present invention, it is preferred the relationship $\Delta T_A - \Delta T_B > 10$ be satisfied, and it is more preferred that the relationship $\Delta T_A - \Delta T_B > 30$ be satisfied. By satisfying the relationship, the above-described effects become further conspicuous. However, when the crystallinity of amorphous polyester is particularly low, there is the case where at least either $T_{mp}$ or $T_{ms}$ is difficult to measure (discrimination is difficult). In such a case, $\Delta T_A$ is taken as ∞[° C.].

The heat of fusion $E_f$ of block polyester obtained in the measurement of endothermic peak of melting temperature by differential scanning calorimetry is preferably 5 mJ/mg or more, and more preferably 15 mJ/mg or more. When the heat of fusion $E_f$ is less than 5 mJ/ml, there is the possibility that the above effects due to having crystalline block cannot be sufficiently exhibited. However, the heat of fusion does not include the quantity of heat of endothermic peak of glass transition temperature. The measuring conditions of the endothermic peak of the heat of fusion are not especially restricted. The heat of fusion can be found as the value measured by, e.g., increasing the temperature of the sample block polyester to 200° C. at a temperature-up velocity of 10° C./min, lowering the temperature at a temperature-down velocity of 10° C./min, and again at a temperature-up velocity of 10° C./min.

Block polyesters are preferably linear type polymers (polymers not having a crosslinked structure). Linear type polymers have a small friction coefficient as compared with crosslinked polymers. Due to a small friction coefficient, excellent lubricating property can be obtained and the transfer efficiency of the toner obtained is further improved.

Block polyesters may have blocks other than the aforementioned crystalline blocks and amorphous blocks.

1-2. Amorphous Polyester:

Amorphous polyesters are lower in crystallinity than the crystalline blocks as described above.

Amorphous polyester is a component that mainly contributes to the improvement of the dispersibility (e.g., dispersibility of colorants, release agents, electrification inhibitors and the like), the pulverizing property of kneaded products in manufacturing a toner, fixing ability of a toner (in particular, low temperature fixing ability), transparency, mechanical characteristics (e.g., elasticity, mechanical strength and the like), electrification property, and moisture resistance of each component constituting a toner. In other words, when amorphous polyesters described later are not contained in a toner, there are cases where characteristics required of the toner as enumerated above are difficult to be sufficiently shown.

The constitutional components of amorphous polyester are described below.

As the alcohol components constituting amorphous polyesters, those having two or more hydroxyl groups can be used, preferably diols having two hydroxyl groups. As such diol components having two hydroxyl groups, aromatic diols having an aromatic cyclic structure and aliphatic diols not having an aromatic cyclic structure are exemplified. As the aromatic diols, e.g., bisphenol A and alkylene oxide adducts of bisphenol A are exemplified. As the aliphatic diols, such as chain diols, e.g., ethylene glycol, 1,3-propanediol, 1,2-propylene glycol, 1,3-propylene glycol, 1,4-butanediol, diethylene glycol, 1,5-pentanediol, 1,6-hexanediol, dipropylene glycol, triethylene glycol, tetraethylene glycol, 1,2-propanediol, 1,3-butanediol, 2,3-butanediol, neopentyl glycol(2,2-dimethylpropane-1,3-diol), 1,2-hexanediol, 2,5-hexane-diol, 2-methyl-2,4-pentanediol, 3-methyl-1,3-pentanediol, 2-ethyl-1,3-hexanediol, 2-butyl-2-ethyl-1,3-propanediol, 2,4-diethyl-1,5-pentanediol, polyethylene glycol, polypropylene glycol, and polytetramethylene glycol, and cyclic diols, e.g., 2,2-bis(4-hydroxycyclohexyl)propane, alkylene oxide adducts of 2,2-bis(4-hydroxycyclohexyl)-propane, 1,4-cyclohexanediol, 1,4-cyclohexanedimethanol, hydrogenated bisphenol A, and alkylene oxide adducts of hydrogenated bisphenol A, are exemplified.

As the carboxylic acid components constituting amorphous polyester, divalent or higher carboxylic acids and derivatives thereof (e.g., acid anhydrides and lower alkyl esters) can be used, but divalent dicarboxylic acids and derivatives thereof are preferably used. The examples of dicarboxylic acids include, e.g., o-phthalic acid (phthalic acid), terephthalic acid, isophthalic acid, succinic acid, adipic acid, sebacic acid, azelaic acid, octylsuccinic acid, cyclohexanedicarboxylic acid, fumaric acid, maleic acid, itaconic acid, and derivatives of these acids (e.g., anhydrides and lower alkyl esters).

The dicarboxylic acid components constituting amorphous polyester are not particularly restricted, but it is preferred that the dicarboxylic acid components at least partially have a terephthalic acid skeleton, more preferably 80 mol % or more of the dicarboxylic acid components have a terephthalic acid skeleton, and still more preferably 90 mol % or more of the dicarboxylic acid components have a terephthalic acid skeleton. By this constitution, the toner finally obtained comes to be a toner well balanced in various characteristics required of the toner.

It is preferred that 50 mol % or more (more preferably 80 mmol % or more) of the monomer components constituting amorphous polyester be the same monomer components constituting amorphous block. That is, amorphous polyester and amorphous block are preferably composed of the same monomer components. The compatibility of block polyester and amorphous polyester becomes particularly excellent by this constitution. The term "monomer components" used here does not mean the monomers used in the manufacture of block polyester and amorphous polyester, but means monomer components contained in block polyester and amorphous polyester.

Amorphous polyester may contain components other than the above diol components and dicarboxylic acid components.

The average molecular weight (weight average molecular weight, Mw) of amorphous polyesters is not particularly limited, but it is preferably from $5\times10^3$ to $4\times10^4$, and more preferably from $8\times10^3$ to $2.5\times10^4$. When the average molecular weight Mw is less than the lower limit, there is the possibility that the mechanical strength of the finally-obtained toner lowers and sufficient durability (storage stability) cannot be obtained. When the average molecular weight Mw is too small, cohesive failure is liable to occur in the fixing of the toner, and the offset resistance tends to lessen. While when the average molecular weight Mw exceeds the upper limit, intercrystalline crack is liable to occur in the fixing of the toner, and the wettability to a transfer material (a recording medium), e.g., paper, lowers, as a result the quantity of heat required in fixing increases.

The glass transition temperature $T_g$ of amorphous polyester is not particularly restricted, but it is preferably from 50 to 75° C., and more preferably from 55 to 70° C. When the glass transition temperature is less than the lower limit, the storage stability (heat resistance) of the toner decreases, and there are cases where fusing occurs among toner particles according to the use environment. On the other hand, when the glass transition temperature exceeds the upper limit, low temperature fixing ability and transparency decrease. When the glass transition temperature is too high, there is the possibility that the effect of the thermal treatment of sphere-making as described later cannot be sufficiently exhibited. Glass transition temperature can be measured in accordance with JIS K 7121.

The softening temperature of amorphous polyester $T_{1/2}$ is not particularly restricted, but it is preferably from 90 to 160° C., more preferably from 100 to 150° C., and still more preferably from 100 to 130° C. When the softening temperature is less than the lower limit, the storage stability of the toner lowers and there is the possibility that sufficient durability cannot be obtained. When the softening temperature is too low, cohesive failure is liable to occur in the fixing of the toner, and the offset resistance tends to lessen. While when the softening temperature exceeds the upper limit, intercrystalline crack is liable to occur in the fixing of the toner, and the wettability to a transfer material (a recording medium), e.g., paper, lowers, as a result the quantity of heat required in fixing increases.

Taking the softening temperature of amorphous polyester as $T_{1/2}(A)$[° C.], and the melting temperature of the block polyester as $T_m(B)$, it is preferred that the relationship $T_m(B)>(T_{1/2}(A)+60)$ be satisfied, and it is more preferred the relationship $(T_{1/2}(A)+60)<T_m(B)<(T_{1/2}(A)+150)$ be satisfied. By satisfying the relationship, the amorphous polyester can be thoroughly softened while ensuring the stability of configuration of the toner powder in a certain degree by the block polyester at relatively high temperature. As a result, the viscosity of the toner particles can be made relatively low near the fixing temperature of the toner and the stress relaxation time of the toner can be prolonged. Further, the thermal sphere-making treatment described later can be carried out efficiently, and the degree of circularity of the toner (toner particles) finally obtained can be further improved by satisfying the above relationship. The toner can exhibit excellent fixing ability in a broad temperature range by satisfying the above relationship.

The softening temperature $T_{1/2}$ can be found as the temperature of the point on the flow curve corresponding to h/2 of the flow chart for analysis which can be obtained by measuring by using a flow tester on conditions of a sample amount of 1 g, pit of the die of 1 mm, length of the die of 1 mm, load of 20 kgf, preheating time of 300 seconds, temperature at starting of measurement of 50° C., and velocity of temperature-up of 5° C./min.

Amorphous polyesters are preferably linear type polymers (polymers not having a crosslinked structure). Linear type polymers have a small friction coefficient as compared with crosslinked polymers. Due to a small friction coefficient, excellent lubricating property can be obtained and the transfer efficiency of the toner obtained is further improved.

As has been described, when block polyesters and amorphous polyesters are used in combination, the characteristics of block polyesters as mentioned above and the characteristics of amorphous polyesters can be compatible, by which it becomes possible for the toner finally obtained to possess resistance against mechanical stresses (to have sufficient physical stability) and show satisfactory fixing ability (fixing strength) in a broad temperature range.

The compounding ratio of block polyester and amorphous polyester is preferably from 5/95 to 45/55 by weight, and more preferably from 10/90 to 30/70. When the compounding ratio of block polyester is too low, the synergistic effect as described above cannot be sufficiently shown, and there is the possibility that the offset resistance of the toner cannot be improved sufficiently. On the other hand, when the compounding ratio of amorphous polyester is too low, the synergistic effect as described above cannot be sufficiently shown, and there is the possibility that satisfactory low temperature fixing ability and transparency cannot be obtained. Further, when the compounding ratio of amorphous polyester is too low, there is the case where efficient and uniform pulverization is difficult in the pulverization process in the manufacture of toner.

Resins (binder resins) may contain components other than the aforementioned polyester resins.

As the resin components other than polyester resins (the third resin components), e.g., homopolymers or copolymers containing styrene or a styrene substitution product, e.g., polystyrene, poly-α-methylstyrene, chloropolystyrene, styrene-chlorostyrene copolymers, styrene-propylene copolymers, styrene-butadiene copolymers, styrene-vinyl chloride copolymers, styrene-vinyl acetate copolymers, styrene-maleic acid copolymers, styrene-acrylic ester copolymers, styrene-methacrylic ester copolymers, styrene-acrylic ester-methacrylic ester copolymers, styrene-α-methyl chloroacrylate copolymers, styrene-acrylonitrile-acrylic ester copolymers, and styrene-vinylmethyl ether copolymers, epoxy resins, urethane-modified epoxy resins, silicone-modified epoxy resins, vinyl chloride resins, rosin-modified maleic acid resins, phenyl resins, polyethylene, polypropylene, ionomer resins, polyurethane resins, silicone resins, ketone resins, ethylene-ethyl acrylate copolymers, xylene resins, polyvinyl butyral resins, terpene resins, phenol resins, aliphatic or alicyclic hydrocarbon resins are exemplified. These resins can be used either individually or as a combination of two or more thereof.

The content of these resins in the materials is not especially restricted, but the content is preferably from 50 to 98 wt. %, and more preferably from 85 to 97 wt. %. When the content of resins is less than the lower limit, there is the possibility that the functions of resins (e.g., good fixing ability in a broad temperature range) cannot be sufficiently shown. On the other hand, when the content of resins exceeds the upper limit, the contents of the components other than resins, e.g., colorants, relatively lower, and it becomes difficult to sufficiently show the characteristics of toners, e.g., coloring.

As the colorants, pigments and dyes etc. can be used. The examples of pigments and dyes include, e.g., carbon black, spirit black, lamp black (C.I. No. 77266), magnetite, titanium black, chrome yellow, zinc chrome, cadmium yellow, mineral fast yellow, navel yellow, Naphthol Yellow S, Hansa Yellow G, Permanent Yellow NCG, chrome yellow, benzidine yellow, quinoline yellow, Tartrazine Lake, chrome orange, molybdenum orange, Permanent Orange GTR, Pyrazolone Orange, Benzidine Orange G, cadmium red, Permanent Red 4R, Watchung Red Calcium Salt, eosine lake, Brilliant Carmine 3B, manganese violet, Fast Violet B, Methyl Violet Lake, Prussian blue, cobalt blue, Alkali Blue Lake, Victoria Blue Lake, Fast Sky Blue, Indanthrene Blue BC, ultramarine, aniline blue, Phthalocyanine Blue, chalcoil blue, chrome green, chromium oxide, Pigment Green B, Malachite Green Lake, Phthalocyanine Green, Final Yellow Green G, Rhodamine 6G, quinacridone, Rose Bengale (C.I. 45432), C.I. Direct Red, C.I. Direct Red 4, C.I. Acid Red, C.I. Basic Red, C.I. Mordant Red 30, C.I. Pigment Red 48:1, C.I. Pigment Red 57:1, C.I. Pigment Red 122, C.I. Pigment Red 184, C.I. Direct Blue 1, C.I. Direct Blue 2, C.I. Acid Blue 9, C.I. Acid Blue 15, C.I. Basic Blue 3, C.I. Basic Blue 5, C.I. Mordant Blue 7, C.I. Pigment Blue 15:1, C.I. Pigment Blue 15:3, C.I. Pigment Blue 5:1, C.I. Direct Green 6, C.I. Basic Green 4, C.I. Basic Green 6, C.I. Pigment Yellow 17, C.I. Pigment Yellow 93, C.I. Pigment Yellow 97, C.I. Pigment Yellow 12, C.I. Pigment Yellow 180, C.I. Pigment Yellow 162, Nigrosine Dye (C.I. No. 50415B), metal complex dyes, metal oxides, e.g., silica, aluminum oxide, magnetite, maghemite, various ferrites, cupric oxide, nickel oxide, zinc oxide, zirconium oxide, titanium oxide, and magnesium oxide, and magnetic materials containing magnetic metals, e.g., Fe, Co or Ni. These pigments and dyes can be used alone or in combination of two or more.

The flow softening temperature (Tm) of the toner of the invention is from 95 to 150° C., preferably from 100 to 140° C., and more preferably from 110 to 130° C. When the flow softening temperature is lower than 95° C., filming resistance is inferior, and when it is higher than 150° C., low temperature fixing property deteriorates.

The glass transition temperature (Tg) of the toner of the invention is from 40 to 70° C., preferably from 45 to 67° C., and more preferably from 50 to 60° C. When the glass transition temperature (Tg) is lower than 40° C., storage stability lowers, and when it is higher than 70° C., Tin increases with the increase of Tg and low temperature fixing property deteriorates.

Since the binder resins in the present invention are great in intermolecular bonding strength and high crystalline polymers, the lowering breadth of Tg can be lessened when the molecule is designed to lower Tm by lowering the molecular weight, therefore, low Tm and low Tg can be compatible. Further, the melt viscosity at running point of 50% can be made from $2\times10^2$ to $3\times10^4$ Pa·s, thus the toner of the invention is preferred for oil-less fixing.

In the toner of the first invention constituted as above, when a toner image by this toner is fixed with, e.g., a fixing unit as shown in FIG. 1(*a*) and (*b*), unfixed toner T of the toner image on paper P is fixed by heating with a main heating member heating roller 110. Since fixing nip part N takes the configuration protruding toward the side of pressing roller 120, paper P is discharged from the outlet of fixing nip part N along by the line of the protruding configuration of nip part N. Therefore, fixed toner T' on the recording medium tries to move along by the main heating member. And the temperature of heating-fixed toner T' on paper P discharged from the fixing nip outlet lowers.

In stress relaxation measurement, initial relaxation modulus G (t=0.01) (Pa) in relaxation time of 0.01 (sec) of the starting time of measuring stress relaxation at 120° C., the temperature lowered after being discharged from the outlet of fixing nip part N, of the toner of the first invention is: initial relaxation modulus G (t=0.01) [Pa]$\geqq1.0\times10^5$ [Pa], thus, toner T melted in fixing nip part N is brought to have relatively sufficient elasticity after being discharged from the outlet of fixing nip part N. Accordingly, toner T does not adhere to heating roller 110 after the outlet of fixing nip part N due to the elasticity, as a result, the winding of paper P round heating roller 110 can be prevented.

In addition, the winding of paper P round heating roller 110 can be prevented, so that it is not necessary to forcedly peel paper P from heating roller 110. Accordingly, when paper P peels off heating roller 110 after the outlet of fixing nip part N, hot offset by the reluctance of separation of toner T' can also be prevented.

Contrary to this, when initial relaxation modulus G (t=0.01) [Pa] of toner T at 120° C. is smaller than $1.0\times10^5$ [Pa], the elasticity of the toner (hardness) is insufficient, the melted toner adheres to the surface of heating roller 110, and the toner does not sufficiently peel off the surface of heating roller 110, as a result the winding of paper P round heating roller 110 is brought about. And when paper P is forcedly peeled off by means of releasing pawl, there is the possibility that hot offset occurs due to the reluctance of separation of the toner for lack of elasticity.

Thus according to the toner of the first invention, good fixing characteristics can be secured even with an oil-less fixing unit as shown in FIG. 1, and the winding of paper P round heating roller 110 can also be prevented by organically combining the adoption of the fixing nip configuration of protruding toward the side of pressing roller 120 and the setting of initial relaxation modulus of toner T at 120° C., G (t=0.01) [Pa], at $1.0\times10^5$ [Pa] or higher.

Although the toner of the first invention is in contact with heating roller 110, the toner is fixed on paper P without adhering to heating roller 110 (without causing offset) by the increase of elasticity and viscosity. Since the toner of the first invention is excellent in offset resistance at high temperature, it is not necessary to coat a release agent, e.g., silicone oil, on the surface of heating roller 110.

In the toner of the second invention constituted as above, when a toner image by this toner is fixed with, e.g., a fixing unit as shown in FIGS. 2(*a*) and (*b*), unfixed toner T of the toner image on paper P is fixed by heating with a main heating member heating roller 210. Since fixing nip part N takes the configuration protruding toward the side of heating roller 210, paper P is discharged from the outlet of fixing nip part N along by the line of the protruding configuration of nip part N. Therefore, fixed toner T' on paper P is peeled off heating roller 210 forcedly. And the temperature of fixed toner T' on paper P discharged from the fixing nip outlet lowers.

At this time, since the ratio of storage modulus G' and loss modulus G" in dynamic relaxation modulus, i.e. loss tangent tan δ, of the toner of the second invention is set at 1.7 or more at 120° C., the loss modulus G" showing the viscosity of the toner reduced in temperature by moving from the fixing nip outlet is greater than the storage modulus G'. By making loss modulus G" greater than storage modulus G', the toner melted in the fixing nip can easily peel off the main heating member heating roller 210 after being discharged from the fixing nip outlet.

However, when the loss modulus G" of toner T' reduced in temperature after the outlet of the fixing nip is too great, viscosity becomes strong and toner T' is too soft, and the reluctance of separation of toner T is liable to occur between heating roller 210 and paper P, since fixed toner T' on paper P is forcedly peeled off heating roller 210. While when the storage modulus G' of toner T' reduced in temperature after the outlet of the fixing nip is too small, the difference between the loss modulus G" showing the viscosity of the toner becomes great, and viscosity is predominant too much, as a result the reluctance of separation of the toner is also liable to occur.

Accordingly, by setting the loss tangent tan δ of toner T at 1.7 to 5.0 at 120° C., the storage modulus G' showing the elasticity and the loss modulus G" showing the viscosity of toner T' reduced in temperature after the outlet of the fixing nip are well balanced, so that hot offset due to the reluctance of separation of toner T' can be effectively prevented when paper P peels off heating roller 210 after the outlet of the fixing nip.

Thus, by the toner of the second invention, good fixing characteristics without bringing about hot offset can be secured with an oil-less fixing unit by organically combining the configuration of fixing nip protruding toward the side of heating roller 210 and setting the loss tangent tan δ of toner T at 1.7 to 5.0 at 120° C.

Further, since the fixing nip takes the configuration of protruding toward the main heating member side, fixed toner T on paper P is forcedly peeled off heating roller 210, thus the winding of paper P around heating roller 210 tends to be controlled, but hot offset of toner T can be prevented and the winding of paper P around heating roller 210 can be more certainly prevented by setting the loss tangent tan δ of toner T at 1.7 to 5.0.

In addition, although the toner is in contact with heating roller 210, the toner is fixed on paper P without adhering (offset) to heater 210 by the increase of elasticity and viscosity. Since the toner of the second invention is excellent in offset resistance at high temperature, it is not necessary to coat a release agent, e.g., silicone oil, on the surface of heating roller 210.

In the toner of the third invention constituted as above, when a toner image by this toner is fixed with, e.g., a fixing unit as shown in FIG. 3, unfixed toner T of the toner image on paper P is fixed by heating with a main heating member heater 311. Since fixing nip part N takes the configuration of flat surface, paper P is discharged from the outlet of fixing nip part N along by the flat surface configuration of nip part N. Therefore, fixed toner on paper P is peeled off heating roller 310 half forcedly. And the temperature of the fixed toner on paper P discharged from the fixing nip outlet lowers.

Since loss tangent tan δ at 180° C. of the toner of the third invention is set at a higher value than loss tangent tan δ at 110° C., loss tangent tans becomes relatively large when a toner is being heated in the fixing nip. Accordingly, storage modulus G' showing the elasticity of the toner is relatively small and loss modulus G" showing the viscosity of the toner is relatively big, thus the toner is sufficiently melted and the heating fixation of the toner is effectively performed.

Further, when the toner moves from the fixing nip outlet and the temperature lowers, loss tangent tan δ becomes relatively small. Thus, storage modulus G' showing the elasticity of the toner becomes relatively big and loss modulus G" showing the viscosity of the toner becomes relatively small, and the reluctance of separation of the toner can be effectively prevented. As a result, the toner melted in the fixing nip easily peels off fixing belt 321 after being discharged from the outlet of fixing nip N, and hot offset due to the reluctance of separation of the toner can be prevented.

Furthermore since the difference between loss tangent tan δ at 180° C. and 110° C. is set at 1 or more, the elasticity of the toner (hardness) at the time when the temperature is lowered after the outlet of fixing nit N can be maintained sufficiently, and it becomes possible to effectively prevent hot offset.

Further, since the fixing nip takes the configuration of flat surface, fixed toner T' on paper P is half forcedly peeled off fixing belt 321, thus the winding of paper P around the fixing belt tends to be controlled, but hot offset of the toner can be prevented and the winding of paper P around the fixing belt can be more certainly prevented by setting loss tangent tan δ at 180° C. at a higher value than loss tangent tan δ at 110° C., and the difference between loss tangent tan δ at 180° C. and 110° C. at 1 or more.

In addition, although the toner is in contact with fixing belt 321, the toner is fixed on paper P without adhering (offset) to fixing belt 321 by the increase of elasticity and viscosity. Since the toner of the third invention is excellent in offset resistance at high temperature, it is not necessary to coat a release agent, e.g., silicone oil, on the surface of fixing belt 321.

Further, The toner of the present invention may contain a charge controlling agent (CCA), and if necessary, a release agent, a dispersant, and magnetic particles. These compounds may be arbitrarily blended by kneading after forming the resin.

Charge controlling agents (CCA) are not particularly restricted, and various kinds of organic and inorganic compounds can be used so long as they can give positive or negative charge by frictional electrification.

As the examples of positive charge controlling agents, e.g., Nigrosine Base EX (manufactured by Orient Chemical Industry Co., Ltd.), quaternary ammonium salt P-51 (manufactured by Orient Chemical Industry Co., Ltd.), Nigrosine Bontoron N-01 (manufactured by Orient Chemical Industry Co., Ltd.), Sudan Chief Schwartz BB (Solvent Black 3: Color Index 26150), Fetschwartz HBN (C.I. No. 26150), Brilliant Spirits Schwartz TN (manufactured by Farben Fabriken Bayer A.G.), and Zapon Schwartz X (manufactured by Farberke Hoechst A.G.), in addition, alkoxylated amine, alkylamide, and molybdic acid chelate pigments are exemplified. Of these compounds, quaternary ammonium salt P-51 is preferably used.

As the examples of negative charge controlling agents, e.g., Oil Black (Color Index 26150), Oil Black BY (manufactured by Orient Chemical Industry Co., Ltd.), Bontoron-S-22 (manufactured by Orient Chemical Industry Co., Ltd.), salicylic acid metal complex E-81 (manufactured by Orient Chemical Industry Co., Ltd.), thioindigo series pigments, sulfonylamine derivatives of copper phthalocyanine, Spiron Black TRH (manufactured by HODOGAYA CHEMICAL Co., Ltd.), Bontron S-34 (manufactured by Orient Chemical Industry Co., Ltd.), Nigrosine SO (manufactured by Orient Chemical Industry Co., Ltd.), Celesschwartz (R) G (manufactured by Farben Fabriken Bayer A.G.), Chromogen-schwartz ETOO (C.I. No. 14645), and Azo Oil Black (R) (manufactured by National Aniline Co.) are exemplified. Of these compounds, salicylic acid metal complex E-81 is preferably used.

These charge controlling agents can be used either individually or as a combination of two or more thereof, and the addition amount of charge controlling agents added to a binder resin is from 0.001 to 5 parts by weight per 100 parts by weight of the binder resin, preferably 0.001 to 3 parts by weight.

The resins having a urethane and a urea bond and polyester resins which are used in the toner of the invention are excellent in heat melt characteristics according to the molecular weight range, and a release agent is not necessary by the viscoelastic characteristics in the fixing temperature range, but when a release agent is used, the amount is 3 parts by weight (3 wt. %) or less per 100 parts by weight of the binder resin, and preferably from 0 to 2 parts by weight.

Thus not only hot offset of the toner and winding of a recording medium can be effectively prevented, but also a good transparent image can be obtained by setting the content of a release agent at 3% or less to thereby reduce the content, or even when a release agent is not used.

The specific examples of release agents include paraffin waxes, polyolefin waxes, modified waxes having an aromatic group, hydrocarbon compounds having an alicyclic group, natural waxes, long chain carboxylic acids having a long chain hydrocarbon chain having 12 or more carbon atoms [$CH_3(CH_2)_{11}$ or $CH_3(CH_2)_{12}$ or higher aliphatic carbon chain], the esters thereof, metal salts of fatty acid, fatty acid amide and fatty acid bisamide. Compounds having different softening temperatures may be used as mixture. The specific examples of paraffin waxes include paraffin waxes (manufactured by NIPPON OIL COMPANY LIMITED), paraffin waxes (manufactured by Nippon Seiro Co., Ltd.), micro-wax waxes (manufactured by NIPPON OIL COMPANY LIMITED), micro-crystalline waxes (manufactured by Nippon Seiro Co., Ltd.), hard paraffin waxes (manufactured by Nippon Seiro Co., Ltd.), PE-130 (manufactured by Hoechst A.G.), Mitsui Hi-Wax 110P (manufactured by Mitsui Petrochemical Industries, Ltd.), Mitsui Hi-Wax 220P (manufactured by Mitsui Petro-chemical Industries, Ltd.), Mitsui Hi-Wax 660P (manufactured by Mitsui Petrochemical Industries, Ltd.), Mitsui Hi-Wax 210P (manufactured by Mitsui Petrochemical Industries, Ltd.), Mitsui Hi-Wax 320P Mitsui Hi-Wax 410P (manufactured by Mitsui Petrochemical Industries, Ltd.), Mitsui Hi-Wax 420P (manufactured by Mitsui Petrochemical Industries, Ltd.), modified wax JC-1141 (manufactured by Mitsui Petrochemical Industries, Ltd.), modified wax JC-2130 (manufactured by Mitsui Petrochemical Industries, Ltd.), modified wax JC-4020 (manufactured by Mitsui Petrochemical Industries, Ltd.), modified wax JC-1142 (manufactured by Mitsui Petrochemical Industries, Ltd.), modified wax JC-5020 (manufactured by Mitsui Petrochemical Industries, Ltd.), beeswax, carnauba wax and montan wax. As fatty acid metal salts, zinc stearate, calcium stearate, magnesium stearate, zinc oleate, zinc palmitate, and magnesium palmitate are exemplified.

As polyolefin waxes, e.g., low molecular weight polypropylene, low molecular weight polyethylene, oxidation type polypropylene and oxidation type polyethylene are exemplified. The specific examples of polyolefin-based waxes include non-oxidation type polyethylene waxes, e.g., Hoechst Wax PE520, Hoechst Wax PE130, Hoechst Wax PE190 (manufactured by Hoechst A.G.), Mitsui Hi-Wax 200, Mitsui Hi-Wax 210, Mitsui-Hi-Wax 210M, Mitsui Hi-Wax 220, Mitsui Hi-Wax 220M (manufactured by Mitsui Petrochemical Industries, Ltd.), and SANWAX 131-P, SANWAX 151-P, SANWAX 161-P (manufactured by Sanyo Chemical Industries Co., Ltd.), oxidation type polyethylene waxes, e.g. Hoechst Wax PED121, Hoechst Wax PED153, Hoechst Wax PED521, Hoechst Wax PED522, Hoechst Wax Ceridust 3620, Hoechst Wax Ceridust VP130, Hoechst Wax Ceridust VP5905, Hoechst Wax Ceridust VP9615A, Hoechst Wax Ceridust TM9610F, Hoechst Wax Ceridust 3715 (manufactured by Hoechst A.G.), Mitsui Hi-Wax 420M (manufactured by Mitsui Petrochemical Industries, Ltd.), and SANWAX E-300, SANWAX E-250P (manufactured by Sanyo Chemical Industries Co., Ltd.), non-oxidation type polypropylene waxes, e.g., Hoechst Wachs PP230 (manufactured by Hoechst A.G.), VISCOL 330-P, VISCOL 550-P, VISCOL 660-P, (manufactured by Sanyo Chemical Industries Co., Ltd.), and oxidation type polypropylene waxes, e.g., VISCOL TS-200 (manufactured by Sanyo Chemical Industries Co., Ltd.). These release agents can be used alone or in combination of two or more. As the release agent added according to necessity, it is preferred to use a compound having a softening temperature (a melting temperature) of from 40 to 130° C., preferably from 50 to 120° C. A softening temperature is an endothermic main peak value on the DSC endothermic curve measured with "DSC120" (a product of Seiko Instruments Inc.).

The mother particles of the toner of the present invention can be obtained by kneading the above compositions, melting, then pulverizing the obtained product by finely grinding member and classifying. A flowability improver may be externally added to the compositions for improving the flowability.

Organic and inorganic fine particles can be used as the flowability improver. For instance, fluorine resin powders, e.g., vinylidene fluoride fine powders, polytetrafluoroethylene fine powders, acrylate resin fine powders; fatty acid metal salts, e.g., zinc stearate, calcium stearate, lead stearate; metal oxides, e.g., iron oxide, aluminum oxide, titanium oxide, zinc oxide; and surface-treated silica obtained by treating silica fine powders manufactured by a wet or dry manufacturing process with a silane coupling agent, a titanium coupling agent or a silicone oil, are exemplified as flowability improvers. These compounds are used either individually or as a combination of two or more thereof.

Preferred flowability improvers are fine powders manufactured by a vapor phase oxidation method of a silicon halogen compound, i.e., so-called dry process silica or fumed silica, which can be manufactured by well-known methods, for example, a method which utilizes heat decomposition oxidation reaction in oxyhydrogen flame of silicon tetrachloride gas, and fundamental reaction formula is as follows.

$$SiCl_4+2H_2+O_2 \rightarrow SiO_2+4HCl$$

Further, in this manufacturing process, it is also possible to obtain complex fine powders of silica with other metal oxides by using other metal halogen compounds, e.g., aluminum chloride or titanium chloride, together with a silicon halogen compound, and these complex fine powders are also included in the scope of the invention. It is preferred for these silica fine powders to have an average primary particle size of from 0.001 to 2 μm, particularly preferably from 0.002 to 0.2 μm. As commercially available silica fine powders manufactured by a vapor phase oxidation method of a silicon halogen compound that are used in the present invention, the following commercial products are exemplified. For instance, AEROSIL 130, AEROSIL 200, AEROSIL 300, AEROSIL 380, TT600, MOX170, MOX80, and COK84 (manufactured by Nippon Aerosil Co., Ltd.), Ca-O-SiL M-5, MS-7, MS-75, HS-5 and EH-5 (manufactured by CABOT Co.), Wacker HDK N20 V15, N20E, T30 and T40 (manufactured by WACKER-CHEMIE GMBH), D-C Fine Silica (manufactured by Dow Corning Co.), and Fransol (manufactured by Fransil Co.) are exemplified.

It is more preferred to use the silica fine powders manufactured by a vapor phase oxidation method of a silicon halogen compound subjected to hydrophobitization treatment. Of the hydrophobitization-treated silica fine powders, those treated so as to have a hydrophobitization degree measured by a methanol titration test of from 30 to 80 are particularly preferred. The hydrophobitization treatment is performed by chemically treating the silica fine powders with organic silicon compounds that react with the silica fine powders or physically adsorbed onto the silica fine powders. A preferred method is treating the silica fine powders manufactured by a vapor phase oxidation method of a silicon halogen compound with an organic silicon compound.

The examples of such organic silicon compounds include hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-hloroethyltrichlorosilane, β-chloroethyltrichlorosilane, chloromethyldimethylchlorosilane, triorganosilylmercaptan, trimethylsilylmercaptan, triorganosilyl acrylate, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and dimethylpolysiloxane having from 2 to 12 siloxane units per a molecule, wherein every unit at terminal has a hydroxyl group bonded to Si. These compounds are used either individually or a combination of two or more therof.

Silica fine powders subjected to hydrophobitization treatment have a particle size of from 0.003 to 0.1 μm, preferably from 0.005 to 0.05 μm. As commercially available products, there are Taranocks 500 (manufactured by Tarco Co.) and AEROSIL R-972 (manufactured by Nippon Aerosil Co., Ltd.).

The addition amount of flowability improvers is from 0.01 to 5 parts by weight per 100 parts by weight of the binder resin, preferably from 0.1 to 3 parts by weight. When the addition amount is less than 0.01 parts by weight, flowability is not improved, and when it is more than 5 parts by weight, fog or blotting occurs or the scattering of the toner in the machine is accelerated.

The manufacturing method of the toner in the present invention is described above with respect to the manufacture of binder polymers (binder resins), and the manufacturing process fundamentally comprises the following steps.

(1) Uniform Blending of Materials

Prescribed amounts of additives, e.g., a binder resin, a charge controlling agent and the like are introduced into a Henschel mixer 20B (manufactured by MITSUI MINING COMPANY, LIMITED) and blended uniformly.

(2) Dispersion and Fixation of Each Additive in Binder Resin

After these materials are uniformly blended, they are melt-kneaded with a two-shaft kneading-extruder (PCM-30, manufactured by Ikegai), and each component is dispersed and fixed in the binder resin. As other melt-kneading member, continuous kneaders, such as "TEM-37 (manufactured by TOSHIBA MACHINE CO., LTD.) and "KRC Kneader" (manufactured by KURIMOTO, LTD.), and batch kneaders, such as heating and pressing kneaders are-exemplified.

(3) Pulverization

After the kneaded product is coarsely pulverized and particle sizes are adjusted, the product is finely pulverized by impinging by jet air with a jet pulverizer "200AFG" (manufactured by HOSOKAWA MICRON CORPORATION), or "IDS-2" (manufactured by Nippon Pneumatic Mfg. Co., Ltd.) to make average particle size from 1 to 8 μm. As other grinding member, mechanical grinder Turbo Mill (manufactured by Kawasaki Heavy Industries, Ltd.) and Super Rotor (manufactured by Nisshin Engineering) are exemplified.

(4) Classification

After removing fine powders, for the purpose of making particle size distribution narrow, the pulverized product is subjected to particle size adjustment by air classification or rotor revolution with air classifier "100 ATP (manufactured by HOSOKAWA MICRON CORPORATION), "DSX-2" (manufactured by Nippon Pneumatic Mfg. Co., Ltd.), or "Elbow Jet" (manufactured by NITTETSU MINING CO., LTD.).

(5) Addition of External Additives

The obtained colored resin particles and a fluidizing agent are introduced each in a prescribed amount into a Henschel mixer 20B (manufactured by MITSUI MINING COMPANY, LIMITED) and uniformly blended, thereby a toner is obtained.

The thus-obtained toners have an average particle size of from 3 to 10 μm, and preferably from 5 to 8 μm, by which high precision can be given. The degree of circularity is from 0.93 to 0.99, and preferably from 0.94 to 0.98, by which toners have excellent flowing and cleaning properties.

Well-known methods can be applied to the measurement of the physical properties of the toner of the invention, e.g., softening temperature (Tm), glass transition temperature (Tg), molecular weight, particle size, storage modulus G', loss modulus G" and relaxation modulus G (t), and the evaluation of good offset region of the toner at fixing time, and examples of these methods are described in Examples and Comparative Examples later.

The toners of the present invention are specifically described with reference to Examples and Comparative Examples.

In the first place, measuring methods of physical properties in Examples of the present invention and Comparative Examples, and the evaluation of good region of offset of a toner at fixing time are described.

(1) Measurement of Softening Temperature (Tm, Melting Temperature) (° C.)

The measurement is performed with constant load extrusion capillary rheometer, Flow Tester CFD-500D (manufactured by Shimadzu Corporation) by the following conditions.

Preparation of a Measuring Sample:

As the measuring sample, about 1 g of a toner is compression-molded to make a cylindrical sample fitting in with the inside diameter of the cylinder of Flow Tester.

Measuring Conditions:

Load: 20 kgf, pit of the die: 1 mm, and length of the die: 1 mm

Measuring Method:

A 1/2 method

Preheating Time:

300 seconds

Starting Temperature of Measurement:

50° C.

Velocity of Temperature Up:

5° C./min

Tm:

The endothermic peak corresponding to crystalline melting temperature (softening temperature) is taken as Tm.

(2) Measurement of Glass Transition Temperature (Tg) (° C.)

Ten (10) mg of a toner is packed in an aluminum cell, and the glass transition temperature is measured with "DSC120" (manufactured by Seiko Instruments Inc.) by the following conditions.

Measuring Temperature:

From 20° C. (starting temperature of measurement) to 200° C. (termination temperature of measurement)

Velocity of Temperature Up:

10° C./min

Tg:

Prom DSC curve that once temperature was raised and the previous hysteresis was erased, the temperature of the shoulder of the endothermic curve where heat absorption corresponding to glass transition temperature occurs is taken as Tg.

(3) Measurement of Molecular Weight and Molecular Weight Distribution:

Preparation of Sample:

About 10 mg of a toner is dissolved in about 10 ml of THF. The insoluble contents in THF were removed through a membrane filter having a pore size of 0.2 μm, to thereby obtain a sample for GPC.

Measuring Instrument:

HLC-8220GPC (manufactured by TOSO CORPORATION)

Column:

TSK Gel Super HZM-M (manufactured by TOSO CORPORATION)

Temperature:

40° C.

Eluate:

Tetrahydrofuran (THF, manufactured by KANTO KAGAKU)

Flow Velocity:

0.35 ml/min

Detector:

UV detector (wavelength of detection: 254 nm)

Standard Sample:

Standard polystyrene (manufactured by TOSO CORPORATION)

(4) Measurement of Particle Size (D50):

In the specification of the present invention, particle size member "average particle size D50".

Particle size is obtained by measuring relative weight distribution by particle size with Coulter Multisizer model III (manufactured by Beckman Coulter, Inc.) and 100 μm aperture tube. Further, the particle sizes of external additives, e.g., silica particles, are measured with an electron microscope.

(5) Measurement of Relaxation Modulus (t) [Pa]

Figure 5A:
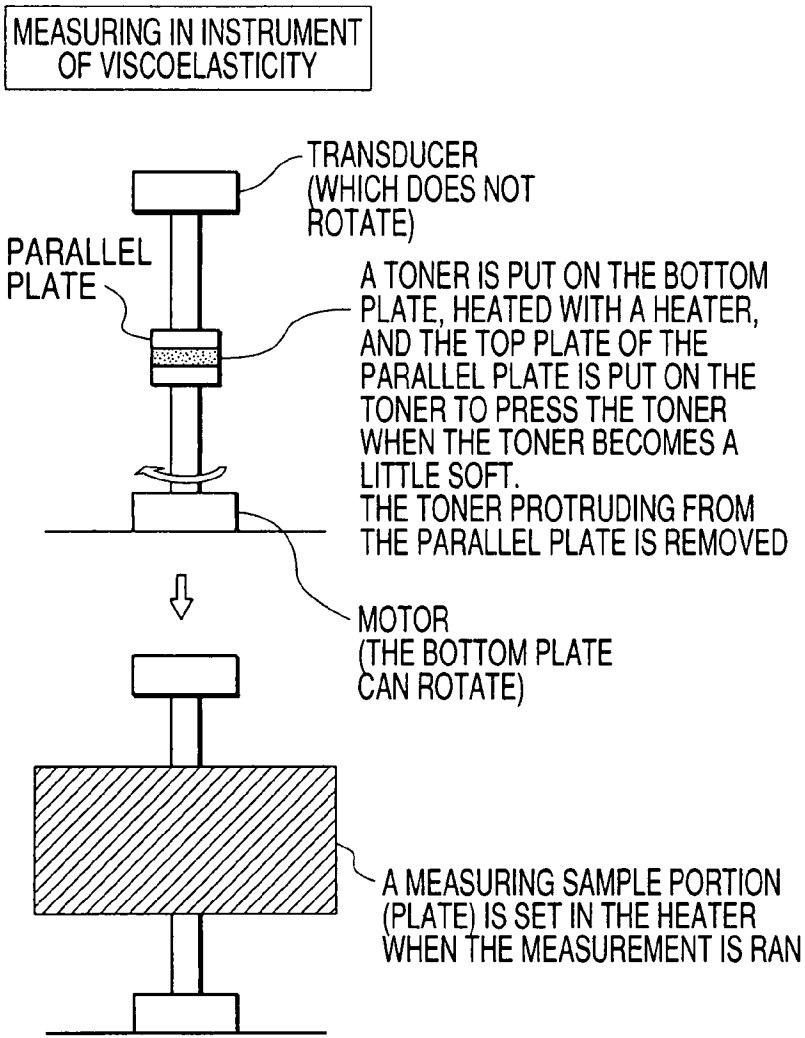
FIG. 5 is a drawing typically showing a measuring instrument of viscoelasticity of a toner.
Figure 5B:
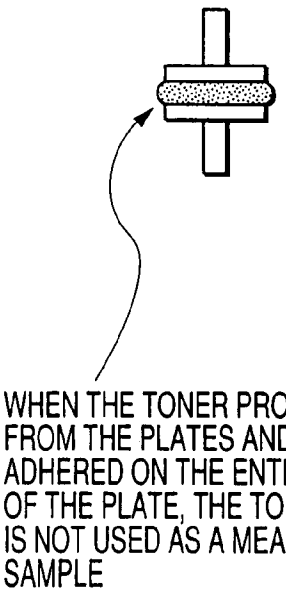
Figure 5C:
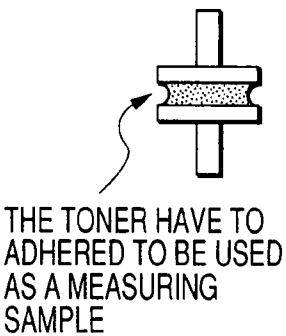

In the first invention, the relaxation modulus G (t) Pa of the toner is obtained by the measurement of viscoelasticity with a viscoelasticity measuring instrument shown in FIG. 5(*a*) by stress relaxation measuring mode (that is, stress relaxation measurement) by the following conditions. Here, stress relaxation measuring mode is a method of suddenly applying previously set quantity of strain to a measuring toner sample, and measuring the stress necessary to maintain the strain by the time elapse. Further, a value obtained by dividing the stress varying by the time elapse by certain strain is the storage modulus G (t) [Pa].

In the first invention, initial relaxation modulus G (t=0.01) Pa in relaxation time of 0.01 (sec), which is the starting time of measuring stress relaxation, at 120° C. considering the reduction of the temperature of the toner after paper discharge from the fixing nip part is found.

Viscoelasticity measuring instrument:

viscoelasticity measuring instrument is ARES viscoelasticity measuring system (ARES viscoelasticity measuring instrument, manufactured by Rheometric Scientific F.E. Company).

Measuring Temperature:

In the first invention, measuring temperature is set at 120° C.

Geometry:

Two parallel plates of top and bottom (ϕ25 mm)

Preparation of Measuring Sample;

About 1 g of a compaction molded toner is put on the bottom plate of the parallel plates, the toner is heated with a heater to the measuring temperature, and the top plate of the parallel plates is put on the toner to press the toner when the toner becomes a little soft. As is shown in FIG. 5(*b*), the toner protruding from the parallel plates is removed by trimming, the toner is fitted in with the peripheral shape of the parallel plates (i.e., the diameter of the parallel plates), and the height of the sample is adjusted to 1.0 to 2.0 mm (the gap between the top and bottom plates) as shown in FIG. 5(*a*), to thereby prepare a cylindrical sample. As is shown in FIG. 5(*c*), when the toner is not adhered on the entire surface of the top and bottom plates, the toner is not used as a measuring sample, as not good (NG).

Quantity of Applied Strain:

Strain is given to the toner by revolving the bottom plate of the parallel plates. At this time the measuring temperature is maintained constant, and gradually greater strain (frequency: 1 (rad/sec) (1 rad/sec=(1/6.28) Hz, strain; from 0.1 to 200%) is given to the measuring sample by strain sweep mode. The maximum strain in the linear region of storage modulus G' and loss modulus G" of dynamic viscoelasticity to the given strain is taken as measuring strain at relaxation modulus measuring time.

Measuring Mode:

Viscoelasticity measurement is performed by stress relaxation measuring mode.

(6) Measurement of Storage Modulus G' and Loss Modulus G", and Computation of Loss Tangent Tan δ

In the second and third invention, storage modulus G' and loss modulus G" of the toner are obtained by measuring viscoelasticity by temperature sweep measuring mode with a viscoelasticity measuring instrument shown in FIG. 5(*a*) by the following conditions.

In the second invention, storage modulus G' and loss modulus G" at 120° C. are measured by temperature sweep measuring mode. Further, loss tangent tan δ=G'/G" of the toner is obtained with the obtained storage modulus G' and loss modulus G".

In the third invention, storage modulus G' and loss modulus G" at 110° C. and 180° C. are measured by temperature sweep measuring mode. Further, loss tangent tan δ=G'/G" at 110° C. and 180° C. of the toner are obtained with the storage modulus G' and loss modulus G" obtained.

Viscoelasticity Measuring Instrument:

Viscoelasticity measuring instrument is ARES viscoelasticity measuring system (ARES viscoelasticity measuring instrument, manufactured by Rheometric Scientific F.E. Company).

Measuring Temperature:

The measuring temperature is the set temperature of fixing (the central value of control of the surface temperature of the heating roller), and the temperature is set at 120 to 200° C. in the second invention, at 110 to 200° C. in the third invention.

Geometry:

Two parallel plates of top and bottom (ϕ25 mm)

Preparation of Measuring Sample:

About 1 g of a compaction molded toner is put on the bottom plate of the parallel plates, the toner is heated with a heater to the measuring temperature, and the top plate of the parallel plates is put on the toner to press the toner when the toner becomes a little soft. As is shown in FIG. 5(*b*), the toner protruding from the parallel plates is removed by trimming, and the toner is fitted in with the peripheral shape of the parallel plates (i.e., the diameter of the parallel plates), and the height of the sample is adjusted to 1.0 to 2.0 mm (the gap between the top and bottom plates) as shown in FIG. 5(*a*), to thereby prepare a cylindrical sample. As is shown in FIG. 5(*c*), when the toner is not adhered on the entire surface of the top and bottom plates, the toner is not used as a measuring sample, as not good (NG).

Quantity of Applied Strain:

Strain is given to the toner by revolving only the bottom plate of the parallel plates. At this time the measuring temperature is maintained constant and gradually greater strain (frequency: 1 (rad/sec) (1 rad/sec=(1/6.28) Hz, strain: from 0.1 to 200%) is given to the measuring sample by strain sweep mode. The maximum strain in the linear region of storage modulus G' and loss modulus G" in dynamic viscoelasticity to the given strain is taken as measuring strain at relaxation modulus measuring time. The maximum strain is measured with each prescribed temperature in the measuring temperature range, and the minimum value of the measured maximum strains is set in automatic measuring mode thereafter.

Measuring Mode:

Viscoelasticity measurement is performed by temperature sweep measuring mode.

(7) Measurement of Diameters of Heating Roller and Pressing Roller

Diameters of heating roller and pressing roller were measured with calipers.

(8) Measurement of Nip Breadth

The temperature of the fixing unit is set at 140° C., the fixing unit is stopped in the middle of the transition of OHP sheet across the fixing unit, and OHP sheet is held-in the nip, after allowing to stand for 3 minutes, OHP sheet is taken out. The trace of nip breadth left on OHP sheet is measured with calipers accurately and the trace is taken as the nip breadth of the fixing unit.

(9) Evaluating Method of Winding

A solid image (adhered amount of the toner: 0.4 mg/cm$^2$) is formed on common paper S for PPC (manufactured by FUJI XEROX OFFICE SUPPLY) with LP-3000C (manufactured by Seiko Epson Corporation) from which a fixing part is detached. The solid image is passed through the fixing unit having the rollers of diameters as shown at prescribed temperature (180° C.) and prescribed fixing nip-transiting time (40 msec). Winding of the paper around the roller is evaluated by visually observing whether the paper winds around the roller of the fixing unit or not. The fixing unit each shown in FIG. 1, FIG. 2 and FIG. 3 are used in the first invention, the second invention and the third invention, respectively.

(10) Evaluation of Good Region of Offset at Fixing Time

An unfixed patch of a square region of 2 cm×2 cm is formed at 10 mm from the end of common paper S for PPC (manufactured by FUJI XEROX OFFICE SUPPLY) by uniformly adhering a toner (adhered amount of the toner: 0.4 mg/cm$^2$) with LP-3000C (manufactured by Seiko Epson Corporation) from which a fixing part is detached. The unfixed patch is passed through the fixing unit described in FIG. 1 having the rollers of diameters as shown at prescribed fixing nip-transiting time (40 msec).

Paper S is passed with varying the temperature from 120 to 200° C. The temperature range which does not leave low temperature or hot offset trace on the paper of the part lower by the circumference of the fixing roller from the position of the fixed patch is taken as a good region of offset by visual judgment.

(11) Measuring Method of Transparency (HAZE Value)

An unfixed patch of 2 cm×2 cm is formed on OHP sheet (Xerox Film, A4 size with no frame) (adhered amount of the toner: 0.4 mg/cm$^2$) with LP-3000C (manufactured by Seiko Epson Corporation) from which a fixing part is detached. The unfixed patch is passed through the fixing unit described in FIG. 1 having the rollers of diameters as shown at prescribed temperature (180° C.) and prescribed fixing nip-transiting time (40 msec). The fixed patch is measured with a turbidimeter (Model 1001DP, manufactured by Nippon Denshoku Industries Co., Ltd.). The smaller the HAZE value, the more transparent is the patch.

EXAMPLES

First Invention

Examples and Comparative Examples of the toners of the first invention are described below. The fixing unit described in FIG. 1 was used in the fixation by the toners in Examples and Comparative Examples.

The manufacture of the resins for the toners of the first invention used in Examples and Comparative Examples is described below.

Resin 1A

A mixture comprising 36 molar parts of neopentyl alcohol, 36 molar parts of ethylene glycol, 48 molar parts of 1,4-cyclohexanediol, 90 molar parts of dimethyl terephthalate, and 10 molar parts of phthalic anhydride was prepared.

A two-liter four-necked flask was equipped with a reflux condenser, a distillation column, a water separator, a nitrogen gas introducing pipe, a thermometer and a stirrer according to an ordinary method, charged with 1,000 g of the above mixture and 1 g of an esterification condensation catalyst, and esterification reaction was carried out with bleeding water and methanol generated at 180° C. from the distillation column. At the point when water and methanol stopped bleeding from the distillation column, the distillation column was detached from the two-liter four-necked flask and a vacuum pump was connected to the four-necked flask. The pressure in the system was lowered to 5 mmHg or less and the reaction system was stirred at a rotary speed of 150 rpm at 200° C. Free diol generated by the condensation reaction was discharged from the system, and the thus-obtained reaction product was taken as resin 1A. Resin 1A had a softening temperature (Tm) of 110° C., a glass transition temperature (Tg) of 60° C., and a weight average molecular weight (Mw) of 13,000.

Resin 2A

A mixture comprising 70 molar parts of resin 1A, 15 molar parts of 1,4-butanediol, and 15 molar parts of dimethyl terephthalate was prepared.

A two-liter four-necked flask was equipped with a reflux condenser, a distillation column, a water separator, a nitrogen gas introducing pipe, a thermometer and a stirrer according to an ordinary method, charged with 1,000 g of the above mixture and 1 g of an esterification condensation catalyst, and esterification reaction was carried out with bleeding water and methanol generated at 200° C. from the distillation column. At the point when water and methanol stopped bleeding from the distillation column, the distillation column was detached from the two-liter four-necked flask and a vacuum pump was connected to the four-necked flask. The pressure in the system was lowered to 5 mmHg or less and the reaction system was stirred at a rotary speed of 150 rpm at 220° C. Free diol generated by the condensation reaction was discharged from the system, and the thus-obtained reaction product was taken as resin 2A. Resin 2A had a softening temperature (Tm) of 149° C., a glass transition temperature (Tg) of 64° C., and a weight average molecular weight (Mw) of 28,000.

Example 1A

To 100 parts by weight of resin 2A was added 20 parts by weight of pigment Toner Magenta 6B (manufactured by Clariant Japan K.K.) as the colorant. The mixture was thoroughly blended by a Henschel mixer and kneaded with a continuous system twin roll kneader (manufactured by MITSUI MINING COMPANY, LIMITED). The kneaded product was coarsely pulverized to a particle size of about 2 mm with a pulverizer (manufactured by HOSOKAWA MICRON CORPORATION), thereby a master batch was obtained.

To 30 parts by weight of the above-obtained master batch, 76 parts by weight of resin 1A, and 1 part by weight of Bontron E-81 (manufactured by Orient Chemical Industry Co., Ltd.) as CCA were added and thoroughly blended with a Henschel mixer, and melt-kneaded with a two-shaft extruder (manufactured by TOSHIBA MACHINE CO., LTD.), cooled to normal temperature (25° C.), pulverized and classified with the above pulverizer and classifier (manufactured by HOSOKAWA MICRON CORPORATION), thereby mother particles having weight D50 of 8 μm were obtained. To 100 parts by weight of the mother particles, 1.0 part by weight of silica RX200 (manufactured by Nippon Aerosil Co., Ltd.) was added and blended with a Henschel mixer, thereby a toner in Example 1A was obtained.

The diameter of the heating roller (HR) of the fixing unit used in the fixation by the toner in Example 1A is 30 mm, and the diameter of the pressing roller (PR) is 35 mm, and the fixing nip breadth at this time is 8.4 mm.

Example 2A

To 100 parts by weight of resin 2A was added 20 parts by weight of pigment Toner Magenta 6B (manufactured by Clariant Japan K.K.) as the colorant. The mixture was thoroughly blended by a Henschel mixer and kneaded with the above continuous system twin roll kneader. The kneaded product was coarsely pulverized to a particle size of about 2 mm with the above pulverizer, to thereby obtain a master batch.

To 30 parts by weight of the above-obtained master batch, 76 parts by weight of resin 1A, 1 part by weight of Bontron E-81 (manufactured by Orient Chemical Industry Co., Ltd.) as CCA, and 1 part by weight of carnauba wax (manufactured by NIPPON WAX CORPORATION) as the release agent were added and thoroughly blended with a Henschel mixer, and melt-kneaded with the above two-shaft extruder, cooled to normal temperature (25° C.), pulverized and classified with the above pulverizer and classifier, thereby mother particles having weight D50 of 8 μm were obtained. To 100 parts by weight of the mother particles, 1.0 part by weight of silica RX200 (manufactured by Nippon Aerosil Co., Ltd.) was added and blended with a Henschel mixer, thereby a toner in Example 2A was obtained.

The diameter of the heating roller (HR) of the fixing unit used in the fixation by the toner in Example 2A is 25 mm, and the diameter of the pressing roller (PR) is also 25 mm, and the fixing nip breadth at this time is 7.1 mm.

Example 3A

To 100 parts by weight of resin 2A was added 20 parts by weight of pigment Toner Magenta 6B (manufactured by Clariant Japan K.K.) as the colorant. The mixture was thoroughly blended by a Henschel mixer and kneaded with the above continuous system twin roll kneader. The kneaded product was coarsely pulverized to a particle size of about 2 mm with the above pulverizer, to thereby obtain a master batch To 30 parts by weight of the above-obtained master batch, 76 parts by weight of resin 1A, 1 part by weight of Bontron E-81 (manufactured by Orient Chemical Industry Co., Ltd.) as CCA, and 3 parts by weight of carnauba wax (manufactured by NIPPON WAX CORPORATION) as the release agent were added and thoroughly blended with a Henschel mixer, and melt-kneaded with the above two-shaft extruder, cooled to normal temperature (25° C.), pulverized and classified with the above pulverizer and classifier, thereby mother particles having weight D50 of 8 μm were obtained. To 100 parts by weight of the mother particles, 1.0 part by weight of silica RX200 (manufactured by Nippon Aerosil Co., Ltd.) was added and blended with a Henschel mixer, thereby a toner in Example 3A was obtained.

The diameter of the heating roller (HR) of the fixing unit used in the fixation by the toner in Example 3A is 30 mm, and the diameter of the pressing roller (PR) is 35 mm, and the fixing nip breadth at this time is 10.7 mm.

Example 4A

To 100 parts by weight of resin 2A was added 10 parts by weight of pigment Toner Magenta 6B (manufactured by Clariant Japan K.K.) as the colorant. The mixture was thoroughly blended by a Henschel mixer and kneaded with the above continuous system twin roll kneader. The kneaded product was coarsely pulverized to a particle size of about 2 mm with the above pulverizer, to thereby obtain a master batch.

To 60 parts by weight of the above-obtained master batch, 46 parts by weight of resin 1A, 1 part by weight of Bontron E-81 (manufactured by Orient Chemical Industry Co., Ltd.) as CCA, and 1 part by weight of carnauba wax (manufactured by NIPPON WAX CORPORATION) as the release agent were added and thoroughly blended with a Henschel mixer, and melt-kneaded with the above two-shaft extruder, cooled to normal temperature (25° C.), pulverized and classified with the above pulverizer and classifier, thereby mother particles having weight D50 of 8 μm were obtained. To 100 parts by weight of the mother particles, 1.0 part by weight of silica RX200 (manufactured by Nippon Aerosil Co., Ltd.) was added and blended with a Henschel mixer, thereby a toner in Example 4A was obtained.

The diameter of the heating roller (HR) of the fixing unit used in the fixation by the toner in Example 4A is 30 mm, and the diameter of the pressing roller (PR) is 35 mm, and the fixing nip breadth at this time is 6.4 mm.

Example 5A

To 100 parts by weight of resin 2A was added 10 parts by weight of pigment Toner Magenta 6B (manufactured by Clariant Japan K.K.) as the colorant. The mixture was thoroughly blended by a Henschel mixer and kneaded with the above continuous system twin roll kneader. The kneaded product was coarsely pulverized to a particle size of about 2 mm with the above pulverizer, to thereby obtain a master batch.

To 60 parts by weight of the above-obtained master batch, 46 parts by weight of resin 1A, 1 part by weight of Bontron E-81 (manufactured by Orient Chemical Industry Co., Ltd.) as CCA, and 1 part by weight of carnauba wax (manufactured by NIPPON WAX CORPORATION) as the release agent were added and thoroughly blended with a Henschel mixer, and melt-kneaded with the above two-shaft extruder, cooled to normal temperature (25° C.), pulverized and classified with the above pulverizer and classifier, thereby mother particles having weight D50 of 8 μm were obtained. To 100 parts by weight of the mother particles, 1.0 part by weight of silica RX200 (manufactured by Nippon Aerosil Co., Ltd.) was added and blended with a Henschel mixer, thereby a toner in Example 5A was obtained.

The diameter of the heating roller (HR) of the fixing unit used in the fixation by the toner in Example 5A is 40 mm, and the diameter of the pressing roller (PR) is 45 mm, and the fixing nip breadth at this time is 11.6 mm.

Comparative Example 1A

To 100 parts by weight of a crosslinked polyester resin (manufactured by Sanyo Chemical Industries Co., Ltd.; softening temperature (Tm): 144° C., glass transition temperature (Tg): 60° C., weight average molecular weight (Mw); 29,000) was added 20 parts by weight of pigment Toner Magenta 6B (manufactured by Clariant Japan K.K.) as the colorant. The mixture was thoroughly blended by a Henschel mixer and kneaded with the above continuous system twin roll kneader. The kneaded product was coarsely pulverized to a particle size of about 2 mm with the above pulverizer, to thereby obtain a master batch.

To 30 parts by weight of the above-obtained master batch, 76 parts by weight of a linear polyester resin (manufactured by Sanyo Chemical Industries Co., Ltd.; softening temperature (Tm): 105° C., glass transition temperature (Tg): 68° C., weight average molecular weight (Mw): 11,500), and 1 part by weight of Bontron E-81 (manufactured by Orient Chemical Industry Co., Ltd.) as CCA were added and thoroughly blended with a Henschel mixer, and melt-kneaded with the above two-shaft extruder, cooled to normal temperature (25° C.), pulverized and classified with the above pulverizer and classifier, thereby mother particles having weight D50 of 8 μm were obtained. To 100 parts by weight of the mother particles, 1.0 part by weight of silica RX200 (manufactured by Nippon Aerosil Co., Ltd.) was added and blended with a Henschel mixer, thereby a toner in Comparative Example 1A was obtained.

The diameter of the heating roller (HR) of the fixing unit used in the fixation by the toner in Comparative Example 1A is 30 mm, and the diameter of the pressing roller (PR) is 35 mm, and the fixing nip breadth at this time is 8.4 mm.

Comparative Example 2A

To 100 parts by weight of a crosslinked polyester resin (manufactured by Sanyo Chemical Industries Co., Ltd.; softening temperature (Tm): 144° C., glass transition temperature (Tg): 60° C., weight average molecular weight (Mw): 29,000) was added 20 parts by weight of pigment Toner Magenta 6B (manufactured by Clariant Japan K.K.) as the colorant. The mixture was thoroughly blended by a Henschel mixer and kneaded with the above continuous system twin roll kneader. The kneaded product was coarsely pulverized to a particle size of about 2 mm with the above pulverizer, to thereby obtain a master batch.

To 30 parts by weight of the above-obtained master batch, 76 parts by weight of a linear polyester resin (manufactured by Sanyo Chemical Industries Co., Ltd.; softening temperature (Tm): 105° C., glass transition temperature (Tg): 68° C., weight average molecular weight (Mw): 11,500), 1 part by weight of Bontron E-81 (manufactured by Orient Chemical Industry Co., Ltd.) as CCA, and 2 parts by weight of carnauba wax (manufactured by NIPPON WAX CORPORATION) as the release agent were added and thoroughly blended with a Henschel mixer, and melt-kneaded with the above two-shaft extruder, cooled to normal temperature (25° C.), pulverized and classified with the above pulverizer and classifier, thereby mother particles having weight D50 of 8 μm were obtained. To 100 parts by weight of the mother particles, 1.0 part by weight of silica RX200 (manufactured by Nippon Aerosil Co., Ltd.) was added and blended with a Henschel mixer, thereby a toner in Comparative Example 2A was obtained.

The diameter of the heating roller (HR) of the fixing unit used in the fixation by the toner in Comparative Example 2A is 25 mm, and the diameter of the pressing roller (PR) is also 25 mm, and the fixing nip breadth at this time is 7.1 mm.

Comparative Example 3A

To 100 parts by weight of a crosslinked polyester resin (manufactured by Sanyo Chemical Industries Co., Ltd.; softening temperature (Tm): 144° C., glass transition temperature (Tg): 60° C., weight average molecular weight (Mw): 29,000) was added 20 parts by weight of pigment Toner Magenta 6B (manufactured by Clariant Japan K.K.) as the colorant. The mixture was thoroughly blended by a Henschel mixer and kneaded with the above continuous system twin roll kneader. The kneaded product was coarsely pulverized to a particle size of about 2 mm with the above pulverizer, to thereby obtain a master batch.

To 40 parts by weight of the above-obtained master batch, 68 parts by weight of a linear polyester resin (manufactured by Sanyo Chemical Industries Co., Ltd.; softening temperature (Tm): 105° C., glass transition temperature (Tg): 68° C., weight average molecular weight (Mw): 11,500), 1 part by weight of Bontron E-81 (manufactured by Orient Chemical Industry Co., Ltd.) as CCA, and 3 parts by weight of carnauba wax (manufactured by NIPPON WAX CORPORATION) as the release agent were added and thoroughly blended with a Henschel mixer, and melt-kneaded with the above two-shaft extruder, cooled to normal temperature (25° C.), pulverized and classified with the above pulverizer and classifier, thereby mother particles having weight D50 of 8 μm were obtained. To 100 parts by weight of the mother particles, 1.0 part by weight of silica RX200 (manufactured by Nippon Aerosil Co., Ltd.) was added and blended with a Henschel mixer, thereby a toner in Comparative Example 3A was obtained.

The diameter of the heating roller (HR) of the fixing unit used in the fixation by the toner in Comparative Example 3A is 40 mm, and the diameter of the pressing roller (PR) is 45 mm, and the fixing nip breadth at this time is 8.8 mm.

Comparative Example 4A

To 100 parts by weight of a crosslinked polyester resin (manufactured by Sanyo Chemical Industries Co., Ltd.; softening temperature (Tm): 144° C., glass transition temperature (Tg): 60° C., weight average molecular weight (Mw): 29,000) was added 10 parts by weight of pigment Toner Magenta 6B (manufactured by Clariant Japan K.K.) as the colorant. The mixture was thoroughly blended by a Henschel mixer and kneaded with the above continuous system twin roll kneader. The kneaded product was coarsely pulverized to a particle size of about 2 mm with the above pulverizer, to thereby obtain a master batch.

To 60 parts by weight of the above-obtained master batch, 46 parts by weight of a linear polyester resin (manufactured by Sanyo Chemical Industries Co., Ltd.; softening temperature (Tm) 105° C., glass transition temperature (Tg): 68° C., weight average molecular weight (Mw): 11,500), 1 part by weight of Bontron E-81 (manufactured by Orient Chemical Industry Co., Ltd.) as CCA, and 5 parts by weight of carnauba wax (manufactured by NIPPON WAX CORPORATION) as the release agent were added and thoroughly blended with a Henschel mixer, and melt-kneaded with the above two-shaft extruder, cooled to normal temperature (25° C.), pulverized and classified with the above pulverizer and classifier, thereby mother particles having weight D50 of 8 μm were obtained. To 100 parts by weight of the mother particles, 1.0 part by weight of silica RX200 (manufactured by Nippon Aerosil Co., Ltd.) was added and blended with a Henschel mixer, thereby a toner in Comparative Example 4A was obtained.

The diameter of the heating roller (HR) of the fixing unit used in the fixation by the toner in Comparative Example 4A is 30 mm, and the diameter of the pressing roller (PR) is 35 mm, and the fixing nip breadth at this time is 10.7 mm.

Comparative Example 5A

To 100 parts by weight of a crosslinked polyester resin (manufactured by Sanyo Chemical Industries Co., Ltd.; softening temperature (Tm): 144° C., glass transition temperature (Tg): 60° C., weight average molecular weight (Mw): 29,000) was added 20 parts by weight of pigment Toner Magenta 6B (manufactured by Clariant Japan K.K.) as the colorant. The mixture was thoroughly blended by a Henschel mixer and kneaded with the above continuous system twin roll kneader. The kneaded product was coarsely pulverized to a particle size of about 2 mm with the above pulverizer, to thereby obtain a master batch.

To 30 parts by weight of the above-obtained master batch, 76 parts by weight of a crosslinked polyester resin (manufactured by Sanyo Chemical Industries Co., Ltd.; softening temperature (Tm): 144° C., glass transition temperature (Tg): 60° C., weight average molecular weight (Mw): 29,000), 1 part by weight of Bontron E-81 (manufactured by Orient Chemical Industry Co., Ltd.) as CCA, and 8 parts by weight of carnauba wax (manufactured by NIPPON WAX CORPORATION) as the release agent were added and thoroughly blended with a Henschel mixer, and melt-kneaded with the above two-shaft extruder, cooled to normal temperature (25° C.), pulverized and classified with the above pulverizer and classifier, thereby mother particles having weight D50 of 8 μm were obtained. To 100 parts by weight of the mother particles, 1.0 part by weight of silica RX200 (manufactured by Nippon Aerosil Co., Ltd.) was added and blended with a Henschel mixer, thereby a toner in Comparative Example 5A was obtained.

The diameter of the heating roller (HR) of the fixing unit used in the fixation by the toner in Comparative Example 5A is 40 mm, and the diameter of the pressing roller (PR) is 45 mm, and the fixing nip breadth is at this time is 11.6 mm.

With these toners in Examples 1A to 5A and Comparative Examples 1A to 5A, amounts of release agent (wt. %) were computed, and initial relaxation modulus G (t=0.01) (Pa) of each toner was measured by the above method. Further, fixing experiment was performed with each toner by the above fixing unit. The nip breadth (mm), temperature range in good region of offset (° C.), and transparency (HAZE) were measured by the above methods, further, the winding of paper was observed by the above method. The results of the toners in Examples 1A to 5A are shown in Table 1A, and the results of the toners in Comparative Examples 1A to 5A are shown in Table 2A.

TABLE 1A

| | Example 1A | Example 2A | Example 3A | Example 4A | Example 5A |
|---|---|---|---|---|---|
| Amount of release agent (wt. %) | 0 | 0.9 | 2.7 | 0.9 | 1.8 |
| Initial relaxation modulus G (t = 0.01) (Pa) | $1.39 \times 10^5$ | $1.39 \times 10^5$ | $3.14 \times 10^5$ | $8.21 \times 10^5$ | $1.18 \times 10^6$ |
| Roller diameters of Fixing unit (HR/PR) (mm) | 30/35 | 25/25 | 30/35 | 30/35 | 40/45 |
| Nip breadth (mm) | 8.4 | 7.1 | 10.7 | 6.4 | 11.6 |
| Winding | No | No | No | No | No |
| Good region of offset (° C.) | 130–195 | 130–195 | 145–200 | 145–190 | 140–200 |
| Transparency (HAZE) (%) | 8.4 | 9.3 | 11.5 | 10.2 | 10.7 |

TABLE 2A

| | Comparative Example 1A | Comparative Example 2A | Comparative Example 3A | Comparative Example 4A | Comparative Example 5A |
|---|---|---|---|---|---|
| Amount of release agent (wt. %) | 0 | 1.8 | 2.7 | 4.5 | 7.0 |
| Initial relaxation modulus G (t = 0.01) (Pa) | $2.3 \times 10^4$ | $2.88 \times 10^4$ | $5.55 \times 10^4$ | $6.74 \times 10^5$ | $4.23 \times 10^5$ |
| Roller diameters of Fixing unit (HR/PR) (mm) | 30/35 | 25/25 | 40/45 | 30/35 | 40/45 |
| Nip breadth (mm) | 8.4 | 7.1 | 8.8 | 10.7 | 11.6 |
| Winding | Yes | Yes | Yes | No | No |
| Good region of offset (° C.) | 140–150 | 130–165 | 130–170 | 130–195 | 130–200 |
| Transparency (HAZE) (%) | 9.2 | 11.1 | 12.4 | 23.5 | 31.2 |

As is understood from the results in Table 1A, initial relaxation modulus G (t=0.01) (Pa) in relaxation time of 0.01 (sec), which is the starting time of measuring stress relaxation, any of the toners in Examples 1A to 5A was $1.0 \times 10^5$ Pa or more at 120° C., and all of the toners in Examples 1A to 5A were not accompanied by the winding of paper P around heating roller 110. Further, all of the toners in Examples 1A to 5A showed the breadth of the temperature range of good region of offset in which low temperature and hot offset traces do not occur of 45° C. or more, thus these toners were confirmed to have a relatively broad temperature range. In addition, all of the toners in Examples 1A to 5A showed the HAZE value of 11.5 or less, thus these toners were confirmed to have good transparency.

Contrary to this, as is apparent from the results in Table 2A, initial relaxation modulus G (t=0.01) (Pa) in relaxation time of 0.01 (sec), the starting time of measuring stress relaxation, any of the toners in Comparative Examples 1A to 3A was $5.55\times10^5$ (Pa) or less at 120° C. Further, it is confirmed that the toners in Comparative Examples 1A to 3A were accompanied by the winding of paper P around heating roller 110. In addition, the toners in Comparative Examples 1A to 3A showed the breadth of the temperature range of good region of offset of 40° C. or less, thus these toners were confirmed to have a relatively narrow temperature range.

Initial relaxation modulus G (t=0.01) (Pa) in relaxation time of 0.01 (sec), which is the starting time of measuring stress relaxation, at 120° C. of the toners in Comparative Examples 4A and 5A was $4.0\times10^5$ (Pa) or more. Further, the toners in Comparative Examples 4A and 5A showed the breadth of the temperature range of good region of offset of 40° C. or less, thus these toners were confirmed to have a relatively broad temperature range. The toners in Comparative Examples 4A and 5A were confirmed that they were not accompanied by the winding of paper P around heating roller 110.

However, the HAZE values of the toners in Comparative Examples 4A and 5A were both higher than 20, thus they were not good in transparency.

Second Invention

Examples and Comparative Examples of the toners of the second invention are described below. The fixing unit described in FIG. 2 was used in the fixation by the toners in Examples and Comparative Examples.

The manufacture of the resins for the toners of the second invention used in Examples and Comparative Examples is described below.

Resin 1B

A mixture comprising 40 molar parts of neopentyl alcohol, 30 molar parts of ethylene glycol, 30 molar parts of 1,4-cyclohexanediol, 105 molar parts of dimethyl terephthalate, and 15 molar parts of phthalic anhydride was prepared.

A two-liter four-necked flask was equipped with a reflux condenser, a distillation column, a water separator, a nitrogen gas introducing pipe, a thermometer and a stirrer according to an ordinary method, charged with 1,000 g of the above mixture and 1 g of an esterification condensation catalyst, and esterification reaction was carried out with bleeding water and methanol generated at 180° C. from the distillation column. At the point when water and methanol stopped bleeding from the distillation column, the distillation column was detached from the two-liter four-necked flask and a vacuum pump was connected to the four-necked flask. The pressure in the system was lowered to 5 mmHg or less and the reaction system was stirred at a rotary speed of 150 rpm at 200° C. Free diol generated by the condensation reaction was discharged from the system, and the thus-obtained reaction product was taken as resin 1B. Resin 1B had a softening temperature (Tm) of 110° C., a glass transition temperature (Tg) of 62° C., and a weight average molecular weight (Mw) of 11,000.

Resin 2B

A mixture comprising 90 molar parts of resin 1B, 5 molar parts of 1,4-butanediol, and 5 molar parts of dimethyl terephthalate was prepared.

A two-liter four-necked flask was equipped with a reflux condenser, a distillation column, a water separator, a nitrogen gas introducing pipe, a thermometer and a stirrer according to an ordinary method, charged with 1,000 g of the above mixture and 1 g of an esterification condensation catalyst, and esterification reaction was carried out with bleeding water and methanol generated at 200° C. from the distillation column. At the point when water and methanol stopped bleeding from the distillation column, the distillation column was detached from the two-liter four-necked flask and a vacuum pump was connected to the four-necked flask. The pressure in the system was lowered to 5 mmHg or less and the reaction system was stirred at a rotary speed of 150 rpm at 220° C. Free diol generated by the condensation reaction was discharged from the system, and the thus-obtained reaction product was taken as resin 2B. Resin 2B had a softening temperature (Tm) of 195° C., a glass transition temperature (Tg) of 64° C., and a weight average molecular weight (Mw) of 21,000.

Example 1B

To 100 parts by weight of resin 2B was added 20 parts by weight of pigment Toner Magenta 6B (manufactured by Clariant Japan K.K.) as the colorant. The mixture was thoroughly blended by a Henschel mixer and kneaded with a continuous system twin roll kneader (manufactured by MITSUI MINING COMPANY, LIMITED). The kneaded product was coarsely pulverized to a particle size of about 2 mm with a pulverizer (manufactured by HOSOKAWA MICRON CORPORATION), thereby a master batch was obtained.

To 30 parts by weight of the above-obtained master batch, 76 parts by weight of resin 1B, and 1 part by weight of Bontron E-81 (manufactured by Orient Chemical Industry Co., Ltd.) as CCA were added and thoroughly blended with a Henschel mixer, and melt-kneaded with a two-shaft extruder (manufactured by TOSHIBA MACHINE CO., LTD.), cooled to normal temperature (25° C.), pulverized and classified with the above pulverizer and classifier (manufactured by HOSOKAWA MICRON CORPORATION), thereby mother particles having weight D50 of 8 μm were obtained. To 100 parts by weight of the mother particles, 1.0 part by weight of silica RX200 (manufactured by Nippon Aerosil Co., Ltd.) was added and blended with a Henschel mixer, thereby a toner in Example 1B was obtained.

The diameter of the heating roller (HR) of the fixing unit used in the fixation by the toner in Example 1B is 30 mm, the diameter of the pressing roller (PR) is 35 mm, and the fixing nip breadth at this time is 8.4 mm.

Example 2B

To 100 parts by weight of resin 2B was added 20 parts by weight of pigment Toner Magenta 6B (manufactured by Clariant Japan K.K.) as the colorant. The mixture was thoroughly blended by a Henschel mixer and kneaded with the above continuous system twin roll kneader. The kneaded product was coarsely pulverized to a particle size of about 2 mm with the above pulverizer, to thereby obtain a master batch.

To 30 parts by weight of the above-obtained master batch, 76 parts by weight of resin 1B, 1 part by weight of Bontron E-81 (manufactured by Orient Chemical Industry Co., Ltd.) as CCA, and 1 part by weight of carnauba wax (manufactured by NIPPON WAX CORPORATION) as the release agent were added and thoroughly blended with a Henschel mixer, and melt-kneaded with the above two-shaft extruder, cooled to normal temperature (25° C.), pulverized and classified with the above pulverizer and classifier, thereby mother particles having weight D50 of 8 μm were obtained. To 100 parts by weight of the mother particles, 1.0 part by weight of silica RX200 (manufactured by Nippon Aerosil Co., Ltd.) was added and blended with a Henschel mixer, thereby a toner in Example 2B was obtained.

The diameter of the heating roller (HER) of the fixing unit used in the fixation by the toner in Example 2B is 20 mm, the diameter of the pressing roller (PR) is 25 mm, and the fixing nip breadth at this time is 6.4 mm.

Example 3B

To 100 parts by weight of resin 2B was added 20 parts by weight of pigment Toner Magenta 6B (manufactured by Clariant Japan K.K.) as the colorant. The mixture was thoroughly blended by a Henschel mixer and kneaded with the above continuous system twin roll kneader. The kneaded product was coarsely pulverized to a particle size of about 2 mm with the above pulverizer, to thereby obtain a master batch.

To 30 parts by weight of the above-obtained master batch, 76 parts by weight of resin 1B, 1 part by weight of Bontron E-81 (manufactured by Orient Chemical Industry Co., Ltd.) as CCA, and 2 parts by weight of carnauba wax (manufactured by NIPPON WAX CORPORATION) as the release agent were added and thoroughly blended with a Henschel mixer, and melt-kneaded with the above two-shaft extruder, cooled to normal temperature (25° C.), pulverized and classified with the above pulverizer and classifier, thereby mother particles having weight D50 of 8 μm were obtained. To 100 parts by weight of the mother particles, 1.0 part by weight of silica RX200 (manufactured by Nippon Aerosil Co., Ltd.) was added and blended with a Henschel mixer, thereby a toner in Example 3B was obtained.

The diameter of the heating roller (HR) of the fixing unit used in the fixation by the toner in Example 3B is 30 mm, the diameter of the pressing roller (PR) is 35 mm, and the fixing nip breadth at this time is 9.3 mm.

Example 4B

To 100 parts by weight of resin 2B was added 10 parts by weight of pigment Toner Magenta 6B (manufactured by Clariant Japan K.K.) as the colorant. The mixture was thoroughly blended by a Henschel mixer and kneaded with the above continuous system twin roll kneader. The kneaded product was coarsely pulverized to a particle size of about 2 mm with the above pulverizer, to thereby obtain a master batch.

To 60 parts by weight of the above-obtained master batch, 46 parts by weight of resin 1B, 1 part by weight of Bontron E-81 (manufactured by Orient Chemical Industry Co., Ltd.) as CCA, and 1 part by weight of carnauba wax (manufactured by NIPPON WAX CORPORATION) as the release agent were added and thoroughly blended with a Henschel mixer, and melt-kneaded with the above two-shaft extruder, cooled to normal temperature (25° C.), pulverized and classified with the above pulverizer and classifier, thereby mother particles having weight D50 of 8 μm were obtained. To 100 parts by weight of the mother particles, 1.0 part by weight of silica RX200 (manufactured by Nippon Aerosil Co., Ltd.) was added and blended with a Henschel mixer, thereby a toner in Example 4B was obtained.

The diameter of the heating roller (HR) of the fixing unit used in the fixation by the toner in Example 4B is 30 mm, the diameter of the pressing roller (PR) is 35 mm, and the fixing nip breadth at this time is 7.5 mm.

Example 5B

To 100 parts by weight of resin 2B was added 10 parts by weight of pigment Toner Magenta 6B (manufactured by Clariant Japan K.K.) as the colorant. The mixture was thoroughly blended by a Henschel mixer and kneaded with the above continuous system twin roll kneader. The kneaded product was coarsely pulverized to a particle size of about 2 mm with the above pulverizer, to thereby obtain a master batch.

To 60 parts by weight of the above-obtained master batch, 46 parts by weight of resin 1B, 1 part by weight of Bontron E-81 (manufactured by Orient Chemical Industry Co., Ltd.) as CCA, and 2 parts by weight of carnauba wax (manufactured by NIPPON WAX CORPORATION) as the release agent were added and thoroughly blended with a Henschel mixer, and melt-kneaded with the above two-shaft extruder, cooled to normal temperature (25° C.), pulverized and classified with the above pulverizer and classifier, thereby mother particles having weight D50 of 8 μm were obtained. To 100 parts by weight of the mother particles, 1.0 part by weight of silica RX200 (manufactured by Nippon Aerosil Co., Ltd.) was added and blended with a Henschel mixer, thereby a toner in Example 5B was obtained.

The diameter of the heating roller (HR) of the fixing unit used in the fixation by the toner in Example 5B is 40 mm, the diameter of the pressing roller (PR) is 45 mm, and the fixing nip breadth at this time is 11.6 mm.

Comparative Example 1B

To 100 parts by weight of a crosslinked polyester resin (manufactured by Sanyo Chemical Industries Co., Ltd.; softening temperature (Tm): 144° C., glass transition temperature (Tg): 60° C., weight average molecular weight (Mw): 29,000) was added 20 parts by weight of pigment Toner Magenta 6B (manufactured by Clariant Japan K.K.) as the colorant. The mixture was thoroughly blended by a Henschel mixer and kneaded with the above continuous system twin roll kneader. The kneaded product was coarsely pulverized to a particle size of about 2 mm with the above pulverizer, to thereby obtain a master batch.

To 30 parts by weight of the above-obtained master batch, 76 parts by weight of a linear polyester resin (manufactured by Sanyo Chemical Industries Co., Ltd.; softening temperature (Tm): 105° C., glass transition temperature (Tg): 68° C., weight average molecular weight (Mw): 11,500), 1 part by weight of Bontron E-81 (manufactured by Orient Chemical Industry Co., Ltd.) as CCA, and 1 part by weight of carnauba wax (manufactured by NIPPON WAX CORPORATION) as the release agent were added and thoroughly blended with a Henschel mixer, and melt-kneaded with the above two-shaft extruder, cooled to normal temperature (25° C.), pulverized and classified with the above pulverizer and classifier, thereby mother particles having weight D50 of 8 μm were obtained. To 100 parts by weight of the mother particles, 1.0 part by weight of silica RX200 (manufactured by Nippon Aerosil Co., Ltd.) was added and blended with a Henschel mixer, thereby a toner in Comparative Example 1B was obtained.

The diameter of the heating roller (HR) of the fixing unit used in the fixation by the toner in Comparative Example 1B is 30 mm, the diameter of the pressing roller (PR) is 35 mm, and the fixing nip breadth at this time is 8.4 mm.

Comparative Example 2B

To 100 parts by weight of a crosslinked polyester resin (manufactured by Sanyo Chemical Industries Co., Ltd.; softening temperature (Tm): 144° C., glass transition temperature (Tg); 60° C., weight average molecular weight (Mw): 29,000) was added 20 parts by weight of pigment Toner Magenta 6B (manufactured by Clariant Japan K.K.) as the colorant. The mixture was thoroughly blended by a Henschel mixer and kneaded with the above continuous system twin roll kneader. The kneaded product was coarsely pulverized to a particle size of about 2 mm with the above pulverizer, to thereby obtain a master batch.

To 30 parts by weight of the above-obtained master batch, 76 parts by weight of a linear polyester resin (manufactured by Sanyo Chemical Industries Co., Ltd.; softening temperature (Tm): 105° C., glass transition temperature (Tg): 68° C., weight average molecular weight (Mw): 11,500), 1 part by weight of Bontron E-81 (manufactured by Orient Chemical Industry Co., Ltd.) as CCA, and 2 parts by weight of carnauba wax (manufactured by NIPPON WAX CORPORATION) as the release agent were added and thoroughly blended with a Henschel mixer, and melt-kneaded with the above two-shaft extruder, cooled to normal temperature (25° C.), pulverized and classified with the above pulverizer and classifier, thereby mother particles having weight D50 of 8 μm were obtained. To 100 parts by weight of the mother particles, 1.0 part by weight of silica RX200 (manufactured by Nippon Aerosil Co., Ltd.) was added and blended with a Henschel mixer, thereby a toner in Comparative Example 2B was obtained.

The diameter of the heating roller (HR) of the fixing unit used in the fixation by the toner in Comparative Example 2B is 25 mm, the diameter of the pressing roller (PR) is also 25 mm, and the fixing nip breadth at this time is 7.1 mm.

Comparative Example 3B

To 100 parts by weight of a crosslinked polyester resin (manufactured by Sanyo Chemical Industries Co., Ltd.; softening temperature (Tm): 144° C., glass transition temperature (Tg): 60° C., weight average molecular weight (Mw): 29,000) was added 20 parts by weight of pigment Toner Magenta 6B (manufactured by Clariant Japan K.K.) as the colorant. The mixture was thoroughly blended by a Henschel mixer and kneaded with the above continuous system twin roll kneader. The kneaded product was coarsely pulverized to a particle size of about 2 mm with the above pulverizer, to thereby obtain a master batch.

To 40 parts by weight of the above-obtained master batch, 68 parts by weight of a linear polyester resin (manufactured by Sanyo Chemical Industries Co., Ltd.; softening temperature (Tm): 105° C., glass transition temperature (Tg): 68° C., weight average molecular weight (Mw): 11,500), 1 part by weight of Bontron E-81 (manufactured by Orient Chemical Industry Co., Ltd.) as CCA, and 3 parts by weight of carnauba wax (manufactured by NIPPON WAX CORPORATION) as the release agent were added and thoroughly blended with a Henschel mixer, and melt-kneaded with the above two-shaft extruder, cooled to normal temperature (25° C.), pulverized and classified with the above pulverizer and classifier, thereby mother particles having weight D50 of 8 μm were obtained. To 100 parts by weight of the mother particles, 1.0 part by weight of silica RX200 (manufactured by Nippon Aerosil Co., Ltd.) was added and blended with a Henschel mixer, thereby a toner in Comparative Example 3B was obtained.

The diameter of the heating roller (HR) of the fixing unit used in the fixation by the toner in Comparative Example 3B is 40 mm, the diameter of the pressing roller (PR) is 45 mm, and the fixing nip breadth at this time is 8.8 mm.

Comparative Example 4B

To 100 parts by weight of a crosslinked polyester resin (manufactured by Sanyo Chemical Industries Co., Ltd.; softening temperature (Tm) 144° C., glass transition temperature (Tg): 60° C., weight average molecular weight (Mw): 29,000) was added 10 parts by weight of pigment Toner Magenta 6B (manufactured by Clariant Japan K.K.) as the colorant The mixture was thoroughly blended by a Henschel mixer and kneaded with the above continuous system twin roll kneader The kneaded product was coarsely pulverized to a particle size of about 2 mm with the above pulverizer, to thereby obtain a master batch.

To 60 parts by weight of the above-obtained master batch, 46 parts by weight of a linear polyester resin (manufactured by Sanyo Chemical Industries Co., Ltd.; softening temperature (Tm): 105° C., glass transition temperature (Tg): 68° C., weight average molecular weight (Mw): 11,500), 1 part by weight of Bontron E-81 (manufactured by Orient Chemical Industry Co., Ltd.) as CCA, and 5 parts by weight of carnauba wax (manufactured by NIPPON WAX CORPORATION) as the release agent were added and thoroughly blended with a Henschel mixer, and melt-kneaded with the above two-shaft extruder, cooled to normal temperature (25° C.), pulverized and classified with the above pulverizer and classifier, thereby mother particles having weight D50 of 8 μm were obtained. To 100 parts by weight of the mother particles, 1.0 part by weight of silica RX200 (manufactured by Nippon Aerosil Co., Ltd.) was added and blended with a Henschel mixer, thereby a toner in Comparative Example 4B was obtained.

The diameter of the heating roller (HR) of the fixing unit used in the fixation by the toner in Comparative Example 4B is 30 mm, the diameter of the pressing roller (PR) is 35 mm, and the fixing nip breadth at this time is 10.7 mm.

Comparative Example 5B

To 100 parts by weight of a crosslinked polyester resin (manufactured by Sanyo Chemical Industries Co., Ltd.; softening temperature (Tm): 144° C., glass transition temperature (Tg): 60° C., weight average molecular weight (Mw): 29,000) was added 20 parts by weight of pigment Toner Magenta 6B (manufactured by Clariant Japan K.K.) as the colorant. The mixture was thoroughly blended by a Henschel mixer and kneaded with the above continuous system twin roll kneader. The kneaded product was coarsely pulverized to a particle size of about 2 mm with the above pulverizer, to thereby obtain a master batch.

To 30 parts by weight of the above-obtained master batch, 76 parts by weight of a crosslinked polyester resin (manufactured by Sanyo Chemical Industries Co., Ltd.; softening temperature (Tm): 144° C., glass transition temperature (Tg): 60° C., weight average molecular weight (Mw): 29,000), 1 part by weight of Bontron E-81 (manufactured by Orient Chemical Industry Co., Ltd.) as CCA, and 8 parts by weight of carnauba wax (manufactured by NIPPON WAX CORPORATION) as the release agent were added and thoroughly blended with a Henschel mixer, and melt-kneaded with the above two-shaft extruder, cooled to normal temperature (25° C.), pulverized and classified with the above pulverizer and classifier, thereby mother particles having weight D50 of 8 μm were obtained. To 100 parts by weight of the mother particles, 1.0 part by weight of silica RX200 (manufactured by Nippon Aerosil Co., Ltd.) was added and blended with a Henschel mixer, thereby a toner in Comparative Example 5B was obtained.

The diameter of the heating roller (HR) of the fixing unit used in the fixation by the toner in Comparative Example 5B is 40 mm, the diameter of the pressing roller (PR) is 45 mm, and the fixing nip breadth at this time is 11.6 mm.

With these toners in Examples 1B to 5B and Comparative Examples 1B to 5B, amounts of release agent (wt. %) were computed. Further, storage modulus G' and loss modulus G" were measured by the above method, and loss tangent tan δ=G"/G' was computed from the obtained G' and G". In addition, fixing experiment was performed with each toner by the above fixing unit. The nip breadth (mm), temperature range in good region of offset (° C.), and transparency (HAZE) were measured by the above methods, further, the winding of paper was observed by the above method. The results of the toners in Examples 1B to 5B are shown in Table 1B, and the results of the toners in Comparative Examples 1B to 5B are shown in Table 2B.

TABLE 1B

| | Example 1B | Example 2B | Example 3B | Example 4B | Example 5B |
|---|---|---|---|---|---|
| Amount of release agent (wt. %) | 0 | 0.9 | 2.7 | 0.9 | 1.8 |
| tanδ | 4.3 | 1.9 | 3.4 | 2.5 | 4.1 |
| Roller diameters of fixing unit (HR/PR) (mm) | 30/35 | 20/25 | 30/35 | 30/35 | 40/45 |
| Nip breadth (mm) | 8.4 | 6.4 | 9.3 | 7.5 | 11.6 |
| Winding | No | No | No | No | No |
| Good region of offset (° C.) | 130–190 | 135–195 | 130–200 | 130–190 | 140–200 |
| Transparency (HAZE) (%) | 9.8 | 10.2 | 12.4 | 10.6 | 12.0 |

TABLE 2B

| | Comparative Example 1B | Comparative Example 2B | Comparative Example 3B | Comparative Example 4B | Comparative Example 5B |
|---|---|---|---|---|---|
| Amount of release agent (wt. %) | 0.9 | 1.8 | 4.5 | 5.6 | 7.0 |
| tanδ | 1.6 | 5.8 | 2.7 | 3.3 | 10.1 |
| Roller diameters of fixing unit (HR/PR) (mm) | 30/35 | 25/25 | 40/45 | 30/35 | 20/25 |
| Nip breadth (mm) | 8.4 | 7.1 | 8.8 | 10.7 | 11.6 |
| Winding | Yes | Yes | No | No | Yes |
| Good region of offset (° C.) | 150–170 | 135–160 | 125–195 | 130–200 | 160–170 |
| Transparency (HAZE) (%) | 8.8 | 13.1 | 25.1 | 26.5 | 33.4 |

As is understood from the results in Table 1B, loss tangent tan δ at 120° C. of each toner in Examples 1B to 5B was from 1.7 to 5.0.

Further, it was confirmed that paper P did not wind around heating roller 210 when the toners in Examples 1B to 5B were used, and all of the toners in Examples 1B to 5B showed the breadth of the temperature range of good region of offset in which low temperature and hot offset traces did not occur of 60° C. or more, thus these toners had a relatively broad temperature range. In addition, all of the toners in Examples 1B to 5B showed the HAZE value of 12.4 or less, thus these toners were confirmed to have good transparency.

Contrary to this, as is apparent from the results in Table 2B, loss tangent tan δ at 120° C. of the toner in Comparative Example 1B was smaller than 1.7. The HAZE value of the toner in Comparative Example 1B was 8.8, and it was confirmed that good transparency could be obtained.

However, the toner in Comparative Example 1B caused the winding of paper P around heating roller 210. Further, the breadth of the temperature range of good region of offset of the toner in Comparative Example 1B was 20° C., thus the toner had a relatively narrow temperature range.

Loss tangent tan δ at 120° C. of the toners in Comparative Examples 2B and 5B was greater than 5. And it was confirmed the toners in Comparative Examples 2B and 5B cause the winding of paper P around heating roller 210. And the breadth of the temperature range of good region of offset of the toners in Comparative Examples 2B and 5B was 25° C. or less, thus these toners had a relatively narrow temperature range. Further, the HAZE value of the toners in Comparative Examples 2B and 5B was 213 or more, and these toners-were inferior in transparency.

Loss tangent tan δ at 120° C. of the toners in Comparative Examples 3B and 4B was from 1.7 to 5, and the breadth of the temperature range of good region of offset of the toners in Comparative Examples 3B and 4B was 65° C. or more, thus these toners had a relatively broad temperature range. Further, it was confirmed that the toners in Comparative Examples 3B and 4B did not cause the winding of paper P around heating roller 210.

However, the toners in Comparative Examples 3B and 4B showed HAZE value of 25 or more, thus these toners were inferior in transparency.

Third Invention

Examples and Comparative Examples of the toners of the third invention are described below. The fixing unit described in FIG. 3 was used in the fixation by the toners in Examples and Comparative Examples.

The manufacture of the resins for the toners of the third invention used in Examples and Comparative Examples is described below.

Resin 1C

A mixture comprising 30 molar parts of neopentyl alcohol, 30 molar parts of ethylene glycol, 30 molar parts of 1,4-cyclohexanediol, 95 molar parts of dimethyl terephthalate, and 10 molar parts of phthalic anhydride was prepared.

A two-liter four-necked flask was equipped with a reflux condenser, a distillation column, a water separator, a nitrogen gas introducing pipe, a thermometer and a stirrer according to an ordinary method, charged with 1,000 g of the above mixture and 1 g of an esterification condensation catalyst, and esterification reaction was carried out with bleeding water and methanol generated at 200° C. from the distillation column. At the point when water and methanol stopped bleeding from the distillation column, the distillation column was detached from the two-liter four-necked flask and a vacuum pump was connected to the four-necked flask. The pressure in the system was lowered to 5 mmHg or less and the reaction system was stirred at a rotary speed of 150 rpm at 200° C. Free diol generated by the condensation reaction was discharged from the system, and the thus-obtained reaction product was taken as resin 1C. Resin 1C had a softening temperature (Tm) of 110° C., a glass transition temperature (Tg) of 63° C., and a weight average molecular weight (Mw) of 15,000.

Resin 2C

A mixture comprising 80 molar parts of resin 1C, 10 molar parts of 1,4-butanediol, and 10 molar parts of dimethyl terephthalate was prepared.

A two-liter four-necked flask was equipped with a reflux condenser, a distillation column, a water separator, a nitrogen gas introducing pipe, a thermometer and a stirrer according to an ordinary method, charged with 1,000 g of the above mixture and 1 g of an esterification condensation catalyst, and esterification reaction was carried out with bleeding water and methanol generated at 220° C. from the distillation column. At the point when water and methanol stopped bleeding from the distillation column, the distillation column was detached from the two-liter four-necked flask and a vacuum pump was connected to the four-necked flask. The pressure in the system was lowered to 5 mmHg or less and the reaction system was stirred at a rotary speed of 150 rpm at 220° C. Free diol generated by the condensation reaction was discharged from the system, and the thus-obtained reaction product was taken as resin 2C. Resin 2C had a softening temperature (Tm) of 168° C., a glass transition temperature (Tg) of 64° C., and a weight average molecular weight (Mw) of 24,000.

Example 1C

To 100 parts by weight of resin 2C was added 20 parts by weight of pigment Toner Magenta 6B (manufactured by Clariant Japan K.K.) as the colorant. The mixture was thoroughly blended by a Henschel mixer and kneaded with a continuous system twin roll kneader (manufactured by MITSUI MINING COMPANY, LIMITED). The kneaded product was coarsely pulverized to a particle size of about 2 mm with a pulverizer (manufactured by HOSOKAWA MICRON CORPORATION), thereby a master batch was obtained.

To 30 parts by weight of the above-obtained master batch, 76 parts by weight of resin 1C, and 1 part by weight of BONTRON E-84 (manufactured by Orient Chemical Industry Co., Ltd.) as CCA were added and thoroughly blended with a Henschel mixer, and melt-kneaded with a two-shaft extruder (manufactured by TOSHIBA MACHINE CO., LTD.), cooled to normal temperature (25° C.), pulverized and classified with the above pulverizer and classifier (manufactured by HOSOKAWA MICRON CORPORATION), thereby mother particles having weight D50 of 8 μm were obtained. To 100 parts by weight of the mother particles, 1.0 part by weight of silica RX200 (manufactured by Nippon Aerosil Co., Ltd.) was added and blended with a Henschel mixer, thereby a toner in Example 1C was obtained.

The fixing nip breadth of the fixing unit used in the fixation by the toner in Example 1C is 10.3 mm.

Example 2C

To 100 parts by weight of resin 2C was added 20 parts by weight of pigment Toner Magenta 6B (manufactured by Clariant Japan K.K.) as the colorant. The mixture was thoroughly blended by a Henschel mixer and kneaded with the above continuous system twin roll kneader. The kneaded product was coarsely pulverized to a particle size of about 2 mm with the above pulverizer, to thereby obtain a master batch.

To 30 parts by weight of the above-obtained master batch, 76 parts by weight of resin 1C, 1 part by weight of BONTRON E-84 (manufactured by Orient Chemical Industry Co., Ltd.) as CCA, and 1 part by weight of carnauba wax (manufactured by NIPPON WAX CORPORATION) as the release agent were added and thoroughly blended with a Henschel mixer, and melt-kneaded with the above two-shaft extruder, cooled to normal temperature (25° C.), pulverized and classified with the above pulverizer and classifier, thereby mother particles having weight D50 of 8 μm were obtained. To 100 parts by weight of the mother particles, 1.0 part by weight of silica RX200 (manufactured by Nippon Aerosil Co., Ltd.) was added and blended with a Henschel mixer, thereby a toner in Example 2C was obtained.

The fixing nip breadth of the fixing unit used in the fixation by the toner in Example 2C is 8.4 mm.

Example 3C

To 100 parts by weight of resin 2C was added 20 parts by weight of pigment Toner Magenta 6B (manufactured by Clariant Japan K.K.) as the colorant. The mixture was thoroughly blended by a Henschel mixer and kneaded with the above continuous system twin roll kneader. The kneaded product was coarsely pulverized to a particle size of about 2 mm with the above pulverizer, to thereby obtain a master batch.

To 30 parts by weight of the above-obtained master batch, 76 parts by weight of resin 1C, 1 part by weight of BONTRON E-84 (manufactured by Orient Chemical Industry Co., Ltd.) as CCA, and 3 parts by weight of carnauba wax (manufactured by NIPPON WAX CORPORATION) as the release agent were added and thoroughly blended with a Henschel mixer, and melt-kneaded with the above two-shaft extruder, cooled to normal temperature (25° C.), pulverized and classified with the above pulverizer and classifier, thereby mother particles having weight D50 of 8 μm were obtained. To 100 parts by weight of the mother particles, 1.0 part by weight of silica RX200 (manufactured by Nippon Aerosil Co., Ltd.) was added and blended with a Henschel mixer, thereby a toner in Example 3C was obtained.

The fixing nip breadth of the fixing unit used in the fixation by the toner in Example 3C is 7.6 mm.

Example 4C

To 100 parts by weight of resin 2C was added 10 parts by weight of pigment Toner Magenta 6B (manufactured by Clariant Japan K.K.) as the colorant. The mixture was thoroughly blended by a Henschel mixer and kneaded with the above continuous system twin roll kneader. The kneaded product was coarsely pulverized to a particle size of about 2 mm with the above pulverizer, to thereby obtain a master batch.

To 60 parts by weight of the above-obtained master batch, 46 parts by weight of resin 1C, 1 part by weight of BONTRON E-84 (manufactured by Orient Chemical Industry Co., Ltd.) as CCA, and 1 part by weight of carnauba wax (manufactured by NIPPON WAX CORPORATION) as the release agent were added and thoroughly blended with a Henschel mixer, and melt-kneaded with the above two-shaft extruder, cooled to normal temperature (25° C.), pulverized and classified with the above pulverizer and classifier, thereby mother particles having weight D50 of 8 μm were obtained. To 100 parts by weight of the mother particles, 1.0 part by weight of silica RX200 (manufactured by Nippon Aerosil Co., Ltd.) was added and blended with a Henschel mixer, thereby a toner in Example 4C was obtained.

The fixing nip breadth of the fixing unit used in the fixation by the toner in Example 4C is 6.1 mm.

Example 5C

To 100 parts by weight of resin 2C was added 10 parts by weight of pigment Toner Magenta 6B (manufactured by Clariant Japan K.K.) as the colorant. The mixture was thoroughly blended by a Henschel mixer and kneaded with the above continuous system twin roll kneader. The kneaded product was coarsely pulverized to a particle size of about 2 mm with the above pulverizer, to thereby obtain a master batch.

To 60 parts by weight of the above-obtained master batch, 46 parts by weight of resin 1C, 1 part by weight of BONTRON E-84 (manufactured by Orient Chemical Industry Co., Ltd.) as CCA, and 2 parts by weight of carnauba wax (manufactured by NIPPON WAX CORPORATION) as the release agent were added and thoroughly blended with a Henschel mixer, and melt-kneaded with the above two-shaft extruder, cooled to normal temperature (25° C.), pulverized and classified with the above pulverizer and classifier, thereby mother particles having weight D50 of 8 μm were obtained. To 100 parts by weight of the mother particles, 1.0 part by weight of silica RX200 (manufactured by Nippon Aerosil Co., Ltd.) was added and blended with a Henschel mixer, thereby a toner in Example 5C was obtained.

The fixing nip breadth of the fixing unit used in the fixation by the toner in Example 5C is 10.9 mm.

Comparative Example 1C

To 100 parts by weight of a crosslinked polyester resin (manufactured by Sanyo Chemical Industries Co., Ltd.; softening temperature (Tm): 144° C., glass transition temperature (Tg): 60° C., weight average molecular weight (Mw): 29,000) was added 20 parts by weight of pigment Toner Magenta 6B (manufactured by Clariant Japan K.K.) as the colorant. The mixture was thoroughly blended by a Henschel mixer and kneaded with the above continuous system twin roll kneader. The kneaded product was coarsely pulverized to a particle size of about 2 mm with the above pulverizer, to thereby obtain a master batch.

To 30 parts by weight of the above-obtained master batch, 76 parts by weight of a linear polyester resin (manufactured by Sanyo Chemical Industries Co., Ltd.; softening temperature (Tm): 105° C., glass transition temperature (Tg): 68° C., weight average molecular weight (Mw): 11,500), 1 part by weight of BONTRON E-84 (manufactured by Orient Chemical Industry Co., Ltd.) as CCA, and 1 part by weight of carnauba wax (manufactured by NIPPON WAX CORPORATION) as the release agent were added and thoroughly blended with a Henschel mixer, and melt-kneaded with the above two-shaft extruder, cooled to normal temperature (25° C.), pulverized and classified with the above pulverizer and classifier, thereby mother particles having weight D50 of 8 μm were obtained. To 100 parts by weight of the mother particles, 1.0 part by weight of silica RX200 (manufactured by Nippon Aerosil Co., Ltd.) was added and blended with a Henschel mixer, thereby a toner in Comparative Example 1C was obtained.

The fixing nip breadth of the fixing unit used in the fixation by the toner in Comparative Example 1C is 10.3 mm.

Comparative Example 2C

To 100 parts by weight of a crosslinked polyester resin (manufactured by Sanyo Chemical Industries Co., Ltd.; softening temperature (Tm): 144° C., glass transition temperature (Tg): 60° C., weight average molecular weight (Mw): 29,000) was added 20 parts by weight of pigment Toner Magenta 6B (manufactured by Clariant Japan K.K.) as the colorant. The mixture was thoroughly blended by a Henschel mixer and kneaded with the above continuous system twin roll kneader. The kneaded product was coarsely pulverized to a particle size of about 2 mm with the above pulverizer, to thereby obtain a master batch.

To 30 parts by weight of the above-obtained master batch, 76 parts by weight of a linear polyester resin (manufactured by Sanyo Chemical Industries Co., Ltd.; softening temperature (Tm): 105° C., glass transition temperature (Tg): 68° C., weight average molecular weight (Mw): 11,500), 1 part by weight of BONTRON E-84 (manufactured by Orient Chemical Industry Co., Ltd.) as CCA, and 2 parts by weight of carnauba wax (manufactured by NIPPON WAX CORPORATION) as the release agent were added and thoroughly blended with a Henschel mixer, and melt-kneaded with the above two-shaft extruder, cooled to normal temperature (25° C.), pulverized and classified with the above pulverizer and classifier, thereby mother particles having weight D50 of 8 μm were obtained. To 100 parts by weight of the mother particles, 1.0 part by weight of silica RX200 (manufactured by Nippon Aerosil Co., Ltd.) was added and blended with a Henschel mixer, thereby a toner in Comparative Example 2C was obtained.

The fixing nip breadth of the fixing unit used in the fixation by the toner in Comparative Example 2C is 7.1 mm.

Comparative Example 3C

To 100 parts by weight of a crosslinked polyester resin (manufactured by Sanyo Chemical Industries Co., Ltd.; softening temperature (Tm): 144° C., glass transition temperature (Tg): 60° C., weight average molecular weight (Mw): 29,000) was added 20 parts by weight of pigment Toner Magenta 6B (manufactured by Clariant Japan K.K.) as the Colorant. The mixture was thoroughly blended by a Henschel mixer and kneaded with the above continuous system twin roll kneader. The kneaded product was coarsely pulverized to a particle size of about 2 mm with the above pulverizer, to thereby obtain a master batch.

To 40 parts by weight of the above-obtained master batch, 68 parts by weight of a linear polyester resin (manufactured by Sanyo Chemical Industries Co., Ltd.; softening temperature (Tm): 105° C., glass transition temperature (Tg): 68° C., weight average molecular weight (Mw): 11,500), 1 part by weight of BONTRON E-84 (manufactured by Orient Chemical Industry Co., Ltd.) as CCA, and 3 parts by weight of carnauba wax (manufactured by NIPPON WAX CORPORATION) as the release agent were added and thoroughly blended with a Henschel mixer, and melt-kneaded with the above two-shaft extruder, cooled to normal temperature (25° C.), pulverized and classified with the above pulverizer and classifier, thereby mother particles having weight D50 of 8 μm were obtained. To 100 parts by weight of the mother particles, 1.0 part by weight of silica RX200 (manufactured by Nippon Aerosil Co., Ltd.) was added and blended with a Henschel mixer, thereby a toner in Comparative Example 3C was obtained.

The fixing nip breadth of the fixing unit used in the fixation by the toner in Comparative Example 3C is 8.8 mm.

Comparative Example 4C

To 100 parts by weight of a crosslinked polyester resin (manufactured by Sanyo Chemical Industries Co., Ltd.; softening temperature (Tm): 144° C., glass transition temperature (Tg): 60° C., weight average molecular weight (Mw): 29,000) was added 10 parts by weight of pigment Toner Magenta 6B (manufactured by Clariant Japan K.K.) as the colorant. The mixture was thoroughly blended by a Henschel mixer and kneaded with the above continuous system twin roll kneader. The kneaded product was coarsely pulverized to a particle size of about 2 mm with the above pulverizer, to thereby obtain a master batch.

To 60 parts by weight of the above-obtained master batch, 46 parts by weight of a linear polyester resin (manufactured by Sanyo Chemical Industries Co., Ltd.; softening temperature (Tm): 105° C., glass transition temperature (Tg): 68° C., weight average molecular weight (Mw): 11,500), 1 part by weight of BONTRON E-84 (manufactured by Orient Chemical Industry Co., Ltd.) as CCA, and 6 parts by weight of carnauba wax (manufactured by NIPPON WAX CORPORATION) as the release agent were added and thoroughly blended with a Henschel mixer, and melt-kneaded with the above two-shaft extruder, cooled to normal temperature (25° C.), pulverized and classified with the above pulverizer and classifier, thereby mother particles having weight D50 of 8 μm were obtained. To 100 parts by weight of the mother particles, 1.0 part by weight of silica RX200 (manufactured by Nippon Aerosil Co., Ltd.) was added and blended with a Henschel mixer, thereby a toner in Comparative Example 4C was obtained.

The fixing nip breadth of the fixing unit used in the fixation by the toner in Comparative Example 4C is 10.7 mm.

Comparative Example 5C

To 100 parts by weight of a crosslinked polyester resin (manufactured by Sanyo Chemical Industries Co., Ltd.; softening temperature (Tm): 144° C., glass transition temperature (Tg): 60° C., weight average molecular weight (Mw): 29,000) was added 20 parts by weight of pigment Toner Magenta 6B (manufactured by Clariant Japan K.K.) as the colorant. The mixture was thoroughly blended by a Henschel mixer and kneaded with the above continuous system twin roll kneader. The kneaded product was coarsely pulverized to a particle size of about 2 mm with the above pulverizer, to thereby obtain a master batch.

To 30 parts by weight of the above-obtained master batch, 76 parts by weight of a crosslinked polyester resin (manufactured by Sanyo Chemical Industries Co., Ltd.; softening temperature (Tm): 144° C., glass transition temperature (Tg): 60° C., weight average molecular weight (Mw): 29,000), 1 part by weight of BONTRON E-84 (manufactured by Orient Chemical Industry Co., Ltd.) as CCA, and 8 parts by weight of carnauba wax (manufactured by NIPPON WAX CORPORATION) as the release agent were added and thoroughly blended with a Henschel mixer, and melt-kneaded with the above two-shaft extruder, cooled to normal temperature (25° C.), pulverized and classified with the above pulverizer and classifier, thereby mother particles having weight D50 of 8 μm were obtained. To 100 parts by weight of the mother particles, 1.0 part by weight of silica RX200 (manufactured by Nippon Aerosil Co., Ltd.) was added and blended with a Henschel mixer, thereby a toner in Comparative Example 5C was obtained.

The fixing nip breadth of the fixing unit used in the fixation by the toner in Comparative Example 5C is 11.6 mm.

With these toners in Examples 1C to 5C and Comparative Examples 1C to 5C, amounts of release agent (wt. %) were computed. Further, storage modulus G' and loss modulus G" were measured by the above method, and loss tangent tan $\delta = G''/G'$ was computed from the obtained G' and G". In addition, fixing experiment was performed with each toner in Examples and Comparative Examples by the above fixing unit. The nip breadth (mm), temperature range in good region of offset (° C.), and transparency (HAZE value) were measured by the above methods, further, the winding of paper was observed by the above method. The results of the toners in Examples 1C to 5C are shown in Table 1C, and the results of the toners in Comparative Examples 1C to 5C are shown in Table 2C.

TABLE 1C

| | Example 1C | Example 2C | Example 3C | Example 4C | Example 5C |
|---|---|---|---|---|---|
| Amount of release agent (wt. %) | 0 | 0.9 | 2.7 | 0.9 | 1.8 |
| tanδ: 180° C./110° C. | 4.2/3.0 | 7.1/3.8 | 5.4/2.3 | 2.5/1.3 | 4.8/2.6 |
| tanδ (180° C. – 110° C.) | 1.2 | 3.3 | 3.1 | 1.2 | 2.2 |
| Nip breadth (mm) | 10.3 | 8.4 | 7.6 | 6.1 | 10.9 |
| Winding | No | No | No | No | No |
| Good region of offset (° C.) | 135–195 | 130–195 | 130–200 | 135–190 | 130–190 |
| Transparency (HAZE) (%) | 9.3 | 12.8 | 12.4 | 10.2 | 11.5 |

TABLE 2C

| | Comparative Example 1C | Comparative Example 2C | Comparative Example 3C | Comparative Example 4C | Comparative Example 5C |
|---|---|---|---|---|---|
| Amount of release agent (wt. %) | 0.9 | 1.8 | 4.5 | 5.3 | 7.0 |
| tanδ: 180° C./110° C. | 2.5/1.6 | 1.3/1.1 | 0.7/1.8 | 2.8/1.3 | 4.2/2.2 |
| tanδ (180° C. − 110° C.) | 0.9 | 0.2 | −1.1 | 1.5 | 2.0 |
| Nip breadth (mm) | 10.3 | 7.1 | 8.8 | 10.7 | 11.6 |
| Winding | Yes | Yes | Yes | No | No |
| Good region of offset (° C.) | 135–150 | 125–140 | 135–160 | 125–195 | 130–200 |
| Transparency (HAZE) (%) | 11.9 | 13.1 | 27.9 | 38.2 | 45.4 |

As is understood from the results in Table 1C, loss tangent tan δ at 180° C. of each toner in Examples 1C to 5C was greater than loss tangent tan δ at 110° C.

Further, it was confirmed that paper P did not wind around heating roller 310 when the toners in Examples 1C to 5C were used, and all of the toners in Examples 1C to 5C showed the breadth of the temperature range of good region of offset in which low temperature and hot offset traces did not occur of 55° C. or more, thus these toners had a relatively broad temperature range.

In addition, all of the toners in Examples 1C to 5C showed the HAZE value of 12.8 or less, i.e., a relatively small value, thus these toners were confirmed to have good transparency.

Further, the amount of release agent of each toner in Examples 1C to 5C was 3 wt. % or less, thus it was confirmed that relatively broad good region of offset could be obtained more effectively, the winding of paper P around fixing belt 321 could be surely prevented, and good transparency could be obtained by using these toners.

Contrary to this, as is apparent from the results in Table 2C, loss tangent tan δ at 180° C. of each of the toners in Comparative Examples 1C and 2C was larger than loss tangent tan δ at 110° C. The amounts of release agent of the toners in Comparative Examples 1C and 2C were 3 wt. % or less, and the HAZE value of the toners in Comparative Examples 1C and 2C was 12.8% or less, and it was confirmed that they had good transparency.

However, the difference between loss tangent tan δ at 180° C. and 110° C. of the toners in Comparative Examples 1C and 2C was smaller than 1, therefore the winding of paper P around heating roller 310 occurs. The breadth of the temperature range of good region of offset of the toners in Comparative Examples 1C and 2C was 15° C., thus these toners had a relatively narrow temperature range Loss tangent tan δ at 180° C. of the toner in Comparative Example 3C was smaller than loss tangent tan δ at 110° C., accordingly the difference between loss tangent tan δ at 180° C. and 110° C. of the toner in Comparative Example 3C was smaller than 1. In addition, the amount of release agent of this toner was 4.5 wt. %, and the winding of paper P around heating roller 310 occurred. And the breadth of the temperature range of good region of offset of the toner in Comparative Example 3C was 25° C., thus the toner has a relatively narrow temperature range. The HAZE value of the toner in Comparative Example 3C was 27.9% or less, thus relatively great and inferior in transparency.

Loss tangent tan δ at 180° C. of the toners in Comparative Examples 4C and 5C was greater than loss tangent tans at 110° C., and the difference between loss tangent tan δ at 180° C. and 110° C. was greater than 1. The temperature range of good region of offset of the toners in Comparative Examples 1C and 2C was 70° C., thus these toners had a relatively broad temperature range.

However, not only the amounts of release agent of each of the toners in Comparative Examples 4C and 5C were more than 3 wt. %, but HAZE value was 38.2%, thus these toners were-inferior in transparency.

In the toner of the first invention having such a constitution, an unfixed toner on a recording medium is fixed by heating by the main heating member of the oil-less fixing unit from the toner surface side. Since the nip part of the oil-less fixing unit takes the configuration protruding toward the pressing member side, the recording medium is discharged from the fixing nip outlet along by the line of the protruding configuration of the fixing nip. Therefore, the fixed toner on the recording medium tries to move along by the main heating member. And the temperature of the fixed toner on the recording medium discharged from the fixing nip outlet comes to lower.

However, in stress relaxation measurement, the toner of the first invention has initial relaxation modulus G (t=0.01) (Pa) in relaxation time of 0.01 (sec), which is the starting time of measuring stress relaxation, at 120° C. of: initial relaxation modulus G (t=0.01) [Pa]$\geqq 1.0\times10^5$ [Pa], thus the toner melted in the fixing nip is brought to have relatively sufficient elasticity after the fixing nip outlet. Accordingly, the toner does not adhere to the heating member after the fixing nip outlet due to the elasticity, as a result, the winding of the recording medium round the heating member after heating fixation can be prevented.

In addition, the winding of a recording medium round the heating member can be prevented, so that it is not necessary to forcedly peel a recording medium from the heating member. Accordingly, when a recording medium peels off the heating member after the fixing nip outlet, hot offset by the reluctance of separation of the toner can also be prevented.

Thus according to the toner of the first invention, good fixing characteristics can be secured even with an oil-less fixing unit, and the winding of the recording medium round the heating member can also be prevented by organically combining the adoption of the fixing nip configuration of protruding toward the pressing member side and the setting of initial relaxation modulus of the toner at 120° C., G (t=0.01) [Pa], at $1.0\times10^5$ [Pa] or higher.

In particular, according to the toner of the first invention, not only hot offset of the toner and winding of a recording medium can be effectively prevented, but also a good transparent image can be obtained by setting the content of a release agent at 3% or less to thereby reduce the content, or even when a release agent is not used.

Although the toner of the first invention is in contact with a heater, the toner is fixed on a recording medium without adhering to the heater (without causing offset) by the increase of elasticity and viscosity. Since the toner of the first invention is excellent in offset resistance at high temperature, it is not necessary to coat a release agent, e.g., silicone oil, on the surface of a heating member.

In the toner of the second invention having such a constitution, an unfixed toner on a recording medium is fixed by heating by the main heating member of the oil-less fixing unit from the fixing side of the toner. Since the fixing nip part of the oil-less fixing unit takes the configuration protruding toward the main heating member side, the recording medium is discharged from the fixing nip outlet along by the line of the protruding configuration of the fixing nip. Therefore, the fixed toner on the recording medium is forcedly peeled off the main heating member. And the temperature of the fixed toner on the recording medium discharged from the fixing nip outlet comes to lower.

Since the ratio of loss modulus G" to storage modulus G' in dynamic relaxation modulus, i.e., loss tangent tan δ of the toner of the second invention, is from 1.7 to 5.0 at 120° C., the loss modulus G" showing the viscosity of the toner reduced in temperature by moving from the fixing nip outlet becomes greater than the storage modulus G'. That the loss modulus G" is greater than the storage modulus G' makes it possible for the toner melted in the fixing nip to easily peel off the main heating member after being discharged from the fixing nip outlet.

However, when the loss modulus G" of the toner reduced in temperature after the outlet of the fixing nip is too great, viscosity becomes strong and the toner is too soft, and the reluctance of separation of the toner is liable to occur between the heating roller and the recording medium, since the fixed toner on the recording medium is forcedly peeled off the main heating member. While when the storage modulus G' of the toner reduced in temperature after the outlet of the fixing nip is too small, the difference between the loss modulus G" showing the viscosity of the toner becomes great, and viscosity is predominant too much, as a result the reluctance of separation of the toner is also liable to occur.

Accordingly, by setting the loss tangent tan δ of the toner at 1.7 to 5.0 at 120° C., the storage modulus G' showing the elasticity and the loss modulus G" showing the viscosity of the toner reduced in temperature after the outlet of the fixing nip are well balanced, so that hot offset due to the reluctance of separation of the toner can be effectively prevented when the recording medium peels off the heating member after the outlet of the fixing nip.

Thus, by the toner of the second invention, good fixing characteristics without bringing about hot offset can be secured with an oil-less fixing unit by organically combining the configuration of fixing nip protruding toward the side of the main heating member and setting the loss tangent tan δ of the toner at 1.7 to 5.0 at 120° C.

In particular, according to the toner of the second invention, not only hot offset of the toner can be effectively prevented, but also a good transparent image can be obtained by setting the content of a release agent at 3% or less to thereby reduce the content, or even when a release agent is not used.

Further, since the fixing nip takes the configuration of protruding toward the main heating member side, the fixed toner on the recording medium is forcedly peeled oft the main heating member, thus the winding of a recording medium around the heating member tends to be controlled, but hot offset of the toner can be prevented and the winding of a recording medium around the heating member can be more certainly prevented by setting the loss tangent tan δ of the toner of the second invention at 1.7 to 5.0.

As described above, although the toner of the second invention is in contact with a heater, the toner is fixed on a recording medium without adhering (offset) to the heater by the increase of elasticity and viscosity. Since the toner of the second invention is excellent in offset resistance at high temperature, it is not necessary to coat a release agent, e.g., silicone oil, on the surface of a heating member.

In the toner of the third invention having such a constitution, an unfixed toner on a recording medium is fixed by heating by the main heating member of the oil-less fixing unit from the fixing side of the toner. Since the fixing nip part of the oil-less fixing unit takes the configuration of flat surface, the recording medium is discharged from the fixing nip outlet along by the line of the flat surface of the fixing nip configuration. Therefore, the fixed toner on the recording medium is half forcedly peeled off the main heating member. And the temperature of the fixed toner on the recording medium discharged from the fixing nip outlet comes to lower.

However, since loss tangent tan δ (=G"/G') at 180° C. of the toner of the third invention is set at a higher value than loss tangent tan δ at 110° C., loss tangent tan δ becomes relatively large when a toner is being heated in the fixing nip. Accordingly, storage modulus G' showing the elasticity of the toner is relatively small and loss modulus G" showing the viscosity of the toner is relatively big, thus the toner is sufficiently melted and the heating fixation of the toner is effectively performed. Further, when the toner moves from the fixing nip outlet and the temperature lowers, loss tangent tan δ becomes relatively small. Thus, storage modulus G' showing the elasticity of the toner becomes relatively big and loss modulus G" showing the viscosity of the toner becomes relatively small, and the reluctance of separation of the toner can be effectively prevented. As a result, the toner melted in the fixing nip easily peels off the main heating member after being discharged from the fixing nip outlet, and hot offset due to the reluctance of separation of the toner can be prevented.

Furthermore since the difference between loss tangent tan δ at 180° C. and 110° C. is set at 1 or more, the elasticity of the toner (hardness) at the time when the temperature is lowered after the fixing nit outlet can be maintained sufficiently, and it becomes possible to effectively prevent hot offset.

In particular, according to the toner of the third invention, not only hot offset of the toner can be effectively prevented, but also a good transparent image can be obtained by setting the content of a release agent at 3 wt. % or less to thereby reduce the content, or even when a release agent is not used.

Further, since the fixing nip takes the configuration of flat surface, the fixed toner on the recording medium is half forcedly peeled off the main heating member, thus the winding of a recording medium around the heating member tends to be controlled, but hot offset of the toner can be prevented and the winding of a recording medium around the heating member can be more certainly prevented by setting loss tangent tan δ (=G"/G') at 180° C. at a higher value than loss tangent tan δ at 110° C., and the difference between loss tangent tan δ at 180° C. and 110° C. at 1 or more.

In addition, the toner of the third invention is fixed on a recording medium without adhering (offset) to the heater by the increase of elasticity and viscosity, although the toner is in contact with a heater. Since the toner of the third invention is excellent in offset resistance at high temperature, it is not necessary to coat a release agent, e.g., silicone oil, on the surface of a heating member.

While the present invention has been described in detail and with reference to specific embodiments thereof, it will be apparent to one skilled in the art that various changes and modifications can be made therein without departing the spirit and scope thereof.

The present application is based on Japanese Patent Application No. 2003-53759, 2003-53760 and 2003-53761, all thereof filed on Feb. 28, 2003, and the contents thereof are incorporated herein by reference.

What is claimed is:

1. A toner for use in an image-forming apparatus equipped with an oil-less fixing unit comprising a main heating member and a pressing member, the main heating member gets in contact with an unfixed toner surface on a recording medium and fixes the unfixed toner at a nip part of the main heating member and the pressing member, the main heating member and the pressing member define a boundary surface thereof, and the surface takes a configuration protruding toward the pressing member side, wherein the toner comprises a resin comprising a block polyester and an amorphous polyester, and the toner has an initial relaxation modulus G (t=0.01) (Pa) of the toner at 120° C., in relaxation time of 0.01 (sec), of G (t=0.01) [Pa]$\geqq 1.0\times10^5$ [Pa].

2. The toner according to claim 1, wherein the toner contains a release agent in an amount of 3 wt. % or less.

3. A toner for use in an image-forming apparatus equipped with an oil-less fixing unit comprising a main heating member and a pressing member, the main heating member gets in contact with an unfixed toner surface on a recording medium and fixes the unfixed toner at a nip part of the main heating member and the pressing member, the main heating member and the pressing member define a boundary surface thereof, and the surface takes a configuration protruding toward the side of the main heating member, wherein the toner comprises a resin comprising a block polyester and an amorphous polyester, and the toner has a loss tangent tan δ (=G"/G') of the toner, a ratio of loss modulus G" to storage modulus G' in dynamic relaxation modulus, of from 1.7 to 5.0 at 120° C.

4. The toner according to claim 3, wherein the toner contains a release agent in an amount of 3 wt. % or less.

5. A toner for use in an image-forming apparatus equipped with an oil-less fixing unit comprising a main heating member and a pressing member, the main heating member gets in contact with an unfixed toner surface on a recording medium and fixes the unfixed toner at a nip part of the main heating member and the pressing member, the main heating member and the pressing member define a boundary surface thereof, and the surface takes a configuration of flat surface, wherein the toner comprises a resin comprising a block polyester and an amorphous polyester, the toner has a larger value of loss tangent tan δ (=G"/G') of the toner, the ratio of loss modulus G" to storage modulus G' in dynamic relaxation modulus, at 180° C. than a value of tan δ at 110° C., wherein the difference between the values of tan δ at 180° C. and 110° C. is 1 or more.

6. The toner according to claim 5, wherein the toner contains a release agent in an amount of 3 wt. % or less.

7. An image-forming system comprising:

an image-forming apparatus; and a toner, wherein said image-forming apparatus is equipped with an oil-less fixing unit comprising a main heating member and a pressing member, the main heating member gets in contact with an unfixed toner surface on a recording medium and fixes the unfixed toner at a nip part of the main heating member and the pressing member, the main heating member and the pressing member define a boundary surface thereof, and the surface takes a configuration protruding toward the pressing member side, and said toner comprises a resin comprising a block polyester and an amorphous polyester, and has an initial relaxation modulus G (t=0.01) (Pa) of the toner at 120° C., in relaxation time of 0.01 (sec), of G (t=0.01) [Pa] $\geqq 1.01\times10^5$ [Pa].

8. An image-forming system comprising:

an image-forming apparatus; and a toner, wherein said image-forming apparatus is equipped with an oil-less fixing unit comprising a main heating member and a pressing member, the main heating member gets in contact with an unfixed toner surface on a recording medium and fixes the unfixed toner at a nip part of the main heating member and the pressing member, the main heating member and the pressing member define a boundary surface thereof, and the surface takes a configuration protruding toward the side of the main heating member, and said toner comprises a resin comprising a block polyester and an amorphous polyester, and has a loss tangent tan δ (=G"/G') of the toner, a ratio of loss modulus G" to storage modulus G' in dynamic relaxation modulus, of from 1.7 to 5.0 at 120° C.

9. An image-forming system comprising:

an image-forming apparatus; and a toner, wherein said image-forming apparatus is equipped with an oil-less fixing unit comprising a main heating member and a pressing member, the main heating member gets in contact with an unfixed toner surface on a recording medium and fixes the unfixed toner at a nip part of the main heating member and the pressing member, the main heating member and the pressing member define a boundary surface thereof, and the surface takes a configuration of fiat surface, and said toner comprises a resin comprising a block polyester and an amorphous polyester, and has a larger value of loss tangent tan δ (=G"/G') of the toner, the ratio of loss modulus G" to storage modulus G' in dynamic relaxation modulus, at 180° C. than a value of tan δ at 110° C.

wherein the difference between the values of tan δ at 180° C. and 110° C. is 1 or more.

* * * * *